US008726801B2

(12) United States Patent
Asakawa et al.

(10) Patent No.: US 8,726,801 B2
(45) Date of Patent: May 20, 2014

(54) CONTROLLING DEVICE FOR SERVO PRESS AND SERVO PRESS EQUIPPED WITH THE CONTROLLING DEVICE

(75) Inventors: Yohei Asakawa, Fujisawa (JP); Toshiya Teramae, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 447 days.

(21) Appl. No.: 12/959,524

(22) Filed: Dec. 3, 2010

(65) Prior Publication Data

US 2011/0132208 A1 Jun. 9, 2011

(30) Foreign Application Priority Data

Dec. 4, 2009 (JP) ..... 2009-276304
Oct. 7, 2010 (JP) ..... 2010-227771

(51) Int. Cl.
*B30B 15/00* (2006.01)

(52) U.S. Cl.
USPC ..... 100/43; 100/50; 72/450

(58) Field of Classification Search
USPC ..... 100/43, 46, 48, 35; 72/35, 384, 403, 72/306, 307, 361, 386, 389.6, 390.6, 29, 72/446, 447, 448, 454, 481.1, 481.14
See application file for complete search history.

(56) References Cited

U.S. PATENT DOCUMENTS 3,488,987 A * 1/1970 Stoeckli ..... 72/329
5,587,633 A * 12/1996 Aoki et al. ..... 318/164
5,970,766 A * 10/1999 Sosa-Razon et al. ..... 72/20.5
7,293,500 B2 * 11/2007 Futamura et al. ..... 100/49
7,434,505 B2 * 10/2008 Suzuki et al. ..... 100/43
2009/0044592 A1 * 2/2009 Shikano et al. ..... 72/382
2011/0132209 A1 * 6/2011 Senda et al. ..... 100/35

FOREIGN PATENT DOCUMENTS

EP 1980339 A1 * 10/2008 ..... B21D 22/20
JP 59-232640 A 12/1984
JP 11047996 * 2/1999 ..... B30B 15/14
JP 11-245098 A 9/1999
JP 11033798 * 9/1999 ..... B30B 15/14
JP 2000-246498 A 9/2000
JP 2002-192398 A 7/2002
JP 2002273628 A * 9/2002 ..... B23P 19/02
JP 2003-154497 A 5/2003
JP 2004-17098 A 1/2004
JP 2006-192467 A 7/2006
JP 2008012588 A * 1/2008 ..... B30B 15/14

OTHER PUBLICATIONS

Machine translation for JP 2002-192398 (listed in IDS), Jul. 10, 2002.*

(Continued)

*Primary Examiner* — Shelley Self
*Assistant Examiner* — Leonal Vasquez
(74) *Attorney, Agent, or Firm* — Crowell & Moring LLP

(57) ABSTRACT

There is provided a controlling technique for a servo press capable of optimal forming for handling variability in a sheet thickness and material property of a workpiece and for handling each workpiece. A controlling device for controlling a servo press in accordance with a slide motion data includes: measurement equipment for measuring a forming state of a workpiece, attached to a die for forming the workpiece; a measurement result receiving portion for receiving a measurement result sent from the measurement equipment; and a slide motion data changing portion for changing a slide motion data for forming the same workpiece at scheduled measuring time in accordance with the measurement result received by the measurement result receiving portion.

2 Claims, 34 Drawing Sheets

(56) References Cited

OTHER PUBLICATIONS

Machine translation for JP 2006-192467 (listed in IDS), Jul. 27, 2006.*

English translation of Japanese Office Action dated Dec. 17, 2013 (four (4) pages).

* cited by examiner

*FIG. 29*

195

SEQUENTIAL FORMING PROGRAM CREATING DISPLAY A

| | MOTION No. | X | Z DESCENT | Z ASCENT |
|---|---|---|---|---|
| 1 | 1 | 0 | 50 | 100 |
| 2 | 1 | 200 | 50 | 100 |
| 3 | 1 | 200 | 50 | 100 |
| 4 | 1 | 300 | 50 | 100 |
| 5 | 1 | 0 | 10 | 60 |
| 6 | 1 | 100 | 10 | 60 |
| 7 | 1 | 200 | 10 | 60 |
| 8 | 1 | 300 | 10 | 60 |
| 9 | 2 | 0 | | |
| 10 | 2 | 100 | | |
| 11 | 2 | 200 | | |
| 12 | 2 | 300 | | |
| 13 | END | | | |

196

81

| | | |
|---|---|---|
| 1 | 2 | 3 |
| 4 | 5 | 6 |
| 7 | 8 | 9 |
| | 0 | |

84 Enter

77 Delete

85 SAVE

86

*FIG. 31*

199

81

SEQUENTIAL FORMING PROGRAM CREATING DISPLAY C

200

| | MOTION No. | Z DESCENT | Z ASCENT | X INITIAL | X END | X PITCH |
|---|---|---|---|---|---|---|
| 1 | 1 | 50 | 100 | 0 | 300 | 100 |
| 2 | 1 | 10 | 60 | 0 | 0 | 0 |
| 3 | 1 | 15 | 60 | 100 | 100 | 0 |
| 4 | 1 | 20 | 60 | 200 | 200 | 0 |
| 5 | 1 | 25 | 60 | 200 | 200 | 0 |
| 6 | 2 | 10 | 30 | 0 | 0 | 0 |
| 7 | 2 | 15 | 30 | 100 | 100 | 0 |
| 8 | 2 | 20 | 30 | 200 | 200 | 0 |
| 9 | 2 | 25 | 30 | 200 | 200 | 0 |
| 10 | END | | | | | |

| | | |
|---|---|---|
| 1 | 2 | 3 |
| 4 | 5 | 6 |
| 7 | 8 | 9 |
| | 0 | |

Enter 84

Delete 77

SAVE 85

86

CONTROLLING DEVICE FOR SERVO PRESS AND SERVO PRESS EQUIPPED WITH THE CONTROLLING DEVICE

CROSS-REFERENCE TO RELATED APPLICATION

The present application claims priority from Japanese Patent Applications No. 2009-276304 filed on Dec. 4, 2009 and No. 2010-227771 filed on Oct. 7, 2010, the content of which are hereby incorporated by reference into this application.

TECHNICAL FIELD OF THE INVENTION

The present invention relates to a controlling technique for a servo press, and more particularly, the present invention relates to a technique effectively applied to a controlling device for a servo press, which controls an electric servo press to carry out slide position control, and a controlling method for the same, and further, a servo press equipped with the controlling device.

BACKGROUND OF THE INVENTION

Among press machines used in formation processes for metal, a device for forming the metal is called a mechanical press, in which rotational motion of a motor is converted to linear motion by using a conversion mechanism of rotational force to linear force, such as a crank mechanism, linkage mechanism, or ball screw mechanism, and a slide is moved in a vertical direction. In a conventional mechanical press, the formation is carried out by providing a flywheel and a clutch between the motor and the conversion mechanism of rotational force to linear force, accumulating kinetic energy in the flywheel and then connecting the clutch, and moving the slide via the conversion mechanism of rotational force to linear force. In recent years, a widespread servo press has a structure in which the power of the servo motor having a large torque is directly connected to the conversion mechanism of rotational force to linear force, without via the flywheel and clutch. Therefore, the structure has the characteristics that complex motions such as low-speed operation, speed change during operation, and temporary stop and reverse rotation during operation, which have been conventionally difficult to be carried out, can be carried out.

Therefore, a controlling device for the servo press is equipped with a function of variously moving the slide by employing, as a formation condition, a data called slide motion data in which time is set on a horizontal axis and a slide height is set on a vertical axis. For example, Patent document 1 describes a forming-pattern selecting device of a servo press for setting the slide motion data, by selecting a formation pattern (slide motion pattern) setting the slide height on the vertical axis and the time on the horizontal axis from eight formation patterns by combination of seven formation patterns each having two positions to eight positions and a spare formation pattern having nine positions or more, and then, inputting the time and slide height of each position.

Also, Patent document 2 describes a controlling device for controlling a position and speed of the slide, in which at least two or more patterns among a "rotation" pattern, "reciprocate" pattern, "shuttle" pattern, and "reciprocate and shuttle" pattern are previously provided, any one of them is selectively switched upon actual process, and a servo motor is controlled based on the selected control pattern.

Further, Patent document 3 describes a servo press and data input procedure for a controlling device capable of creating new slide motion data based on existing slide motion data as changing the data so as to facilitate setting of a forming condition which is complicated by the servo press.

Still further, Patent document 4 describes a dead-bottom-position probing device of a servo press, as targeting a servo press using the ball screw mechanism, for measuring a process depth of a product by image processing, and then, reciprocating a motor at a predetermined depth and pulling it up by using ability that the motor can be reciprocated at an arbitrary position.

Patent Documents

[Patent Document 1] Japanese Patent Application Laid-Open Publication No. H11-245098

[Patent Document 2] Japanese Patent Application Laid-Open Publication No. 2004-17098

[Patent Document 3] Japanese Patent Application Laid-Open Publication No. 2006-192467

[Patent Document 4] Japanese Patent Application Laid-Open Publication No. 2002-192398

DISCLOSURE OF THE INVENTION

Incidentally, as described above in the Patent documents 1 to 3, in the conventional servo press, the slide is configured so as to be operated based on the predetermined slide motion data. However, in actual press forming, an optimal forming condition is different depending on a sheet thickness and material property, and therefore, it is desirable to change the forming condition in every lot, ideally, every workpiece.

Also, in a method in the above-described Patent document 4, a forming depth can be changed in every workpiece only in a coining forming for the servo press using the ball screw mechanism. This method is a method that the forming depth is measured in every forming of a predetermined micro depth such as 1 micrometer, and, after reaching a predetermined depth, a ram is moved up, so that the forming is finished. In this forming method, it is not assumed that the further forming is carried out after the measurement, and this method cannot handle a forming method for using feedback control such that a springback magnitude in bend forming is measured and the forming is carried out in consideration of the springback magnitude. Therefore, a controlling device for carrying out higher-precision control by utilizing sophisticated functions of hardware of a servo press is desired.

Accordingly, a preferred aim of the present invention is to provide a controlling technique for a servo press capable of optimal forming for handling variability in a sheet thickness and material property of a workpiece and for handling each workpiece.

The above and other preferred aims and novel characteristics of the present invention will be apparent from the description of the present specification and the accompanying views.

A typical arrangement of the inventions disclosed in the present application will be briefly described as follows.

That is, such a typical arrangement is applied to a controlling device for a servo press in accordance with a slide motion data, a controlling method for controlling the same, and a servo press equipped with the controlling device, and has characteristics as follows.

A controlling device for a servo press has: measurement equipment for measuring a forming state of the workpiece, which is attached to a die for forming a workpiece; a measurement result receiving portion for receiving a measurement result sent from the measurement equipment; and a slide motion data changing portion for changing a slide motion data (a data for determining a forming operation of the workpiece) for forming the same workpiece at scheduled measuring time in accordance with the measurement result received by the measurement result receiving portion.

Further, the controlling device includes: a slide motion pattern creating portion for creating a slide motion pattern which is a form data (common pattern data) of the slide motion data; and a slide motion pattern entering portion for newly adding a slide motion pattern, which is created by the slide motion pattern creating portion, to a memory portion for storing the slide motion data. Still Further, the controlling device includes a slide motion data creating portion for creating a new slide motion data based on the slide motion pattern.

Still Further, the controlling device includes: a memory portion for storing a slide-height/motor-rotation-angle correspondence table; a slide position calculating portion for sending a slide height command of a slide based on the slide motion data; and a motor speed commanding portion for sending a servo motor speed command to a servo amplifier of the servo motor in accordance with the slide height command sent by the slide position command calculating portion with utilizing the slide-height/motor-rotation-angle correspondence table. Still further, the controlling device includes: a slide-height/motor-rotation-angle correspondence table creating portion; and a slide-height/motor-rotation-angle correspondence table entering portion for newly adding the created slide-height/motor-rotation-angle correspondence table to the memory portion.

Still further, in another controlling device for a servo press, the present invention is applied to a controlling device for a servo press for sequential forming by controlling the servo press for forming a workpiece with using a die having a die actuator, and the controlling device includes: measurement equipment for measuring a forming state of the workpiece attached to the die for forming the workpiece; a measurement result receiving portion for receiving a measurement result sent from the measurement equipment; a slide motion data changing portion for changing a slide motion data for forming the same workpiece at scheduled measuring time in accordance with the measurement result received by the measurement result receiving portion; and a die actuator drive command sending portion for driving the die actuator so as to carry out a motion for adjust forming a plurality of times per one workpiece, in accordance with the slide motion data changed by the slide motion data changing portion.

Still further, the controlling device includes: a memory portion for storing a sequential forming program data for carrying out the sequential forming; a sequential forming program creating portion for creating the sequential forming program data; and a sequential forming program entering portion for entering the sequential forming program data, which is created by the sequential forming program creating portion, to the memory portion.

Still further, in another controlling device for a servo press, the present invention is applied to a controlling device for a servo press for sequential forming by controlling the servo press for forming a workpiece with using a die having a die actuator, and the controlling device includes: measurement equipment for measuring a forming state of the workpiece attached to the die for forming the workpiece; a measurement result receiving portion for receiving a measurement result sent from the measurement equipment, after forming the workpiece once or more; a slide motion data changing portion for changing a slide motion data for a next slide motion or a subsequent slide motion in accordance with the measurement result receiving portion; and a die actuator drive command sending portion for driving the die actuator so as to carry out the forming in accordance with the slide motion data changed by the slide motion data changing portion.

Still further, the controlling device includes: a memory portion for storing a sequential forming program data for the sequential forming; a sequential forming program creating portion for creating the sequential forming program data; and a sequential forming program entering portion for entering the sequential forming program data created by the sequential forming program creating portion to the memory portion.

The effects obtained by typical aspects of the present invention will be briefly described below.

That is, the effects obtained by the typical aspects can achieve optimal forming for handling variability in a sheet thickness and material property of a workpiece and for handling each workpiece. As a result, precision and quality of formed products can be improved.

BRIEF DESCRIPTIONS OF THE DRAWINGS

FIG. 29 is a view illustrating a sequential forming program creating display "A" in the example forming method showing the effects of the present invention in the servo press according to the second embodiment of the present invention;

FIG. 31 is a view illustrating a sequential forming program creating display "C" in the example forming method showing the effects of the present invention in the servo press according to the second embodiment of the present invention;

Figure 35:
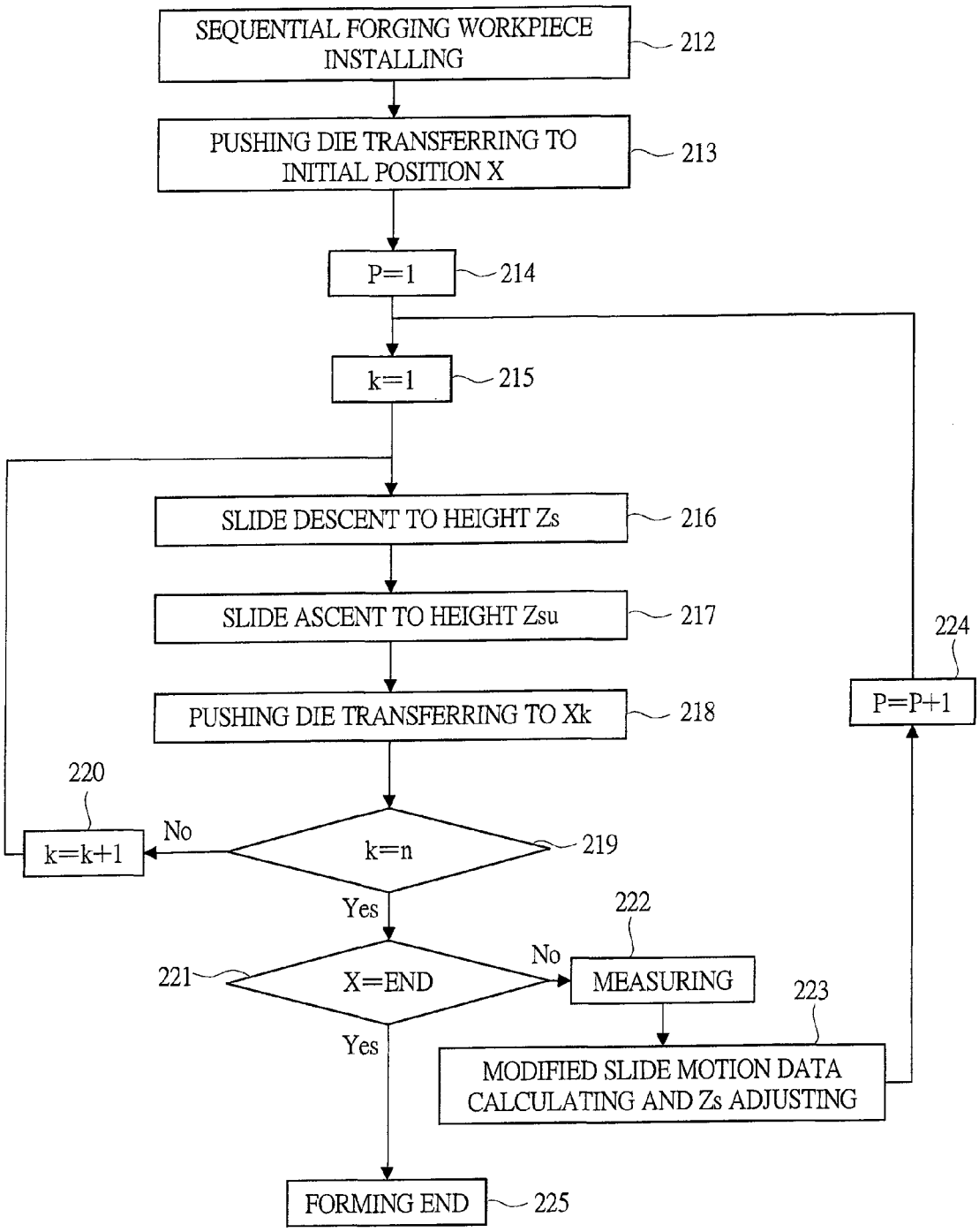
Figure 36:
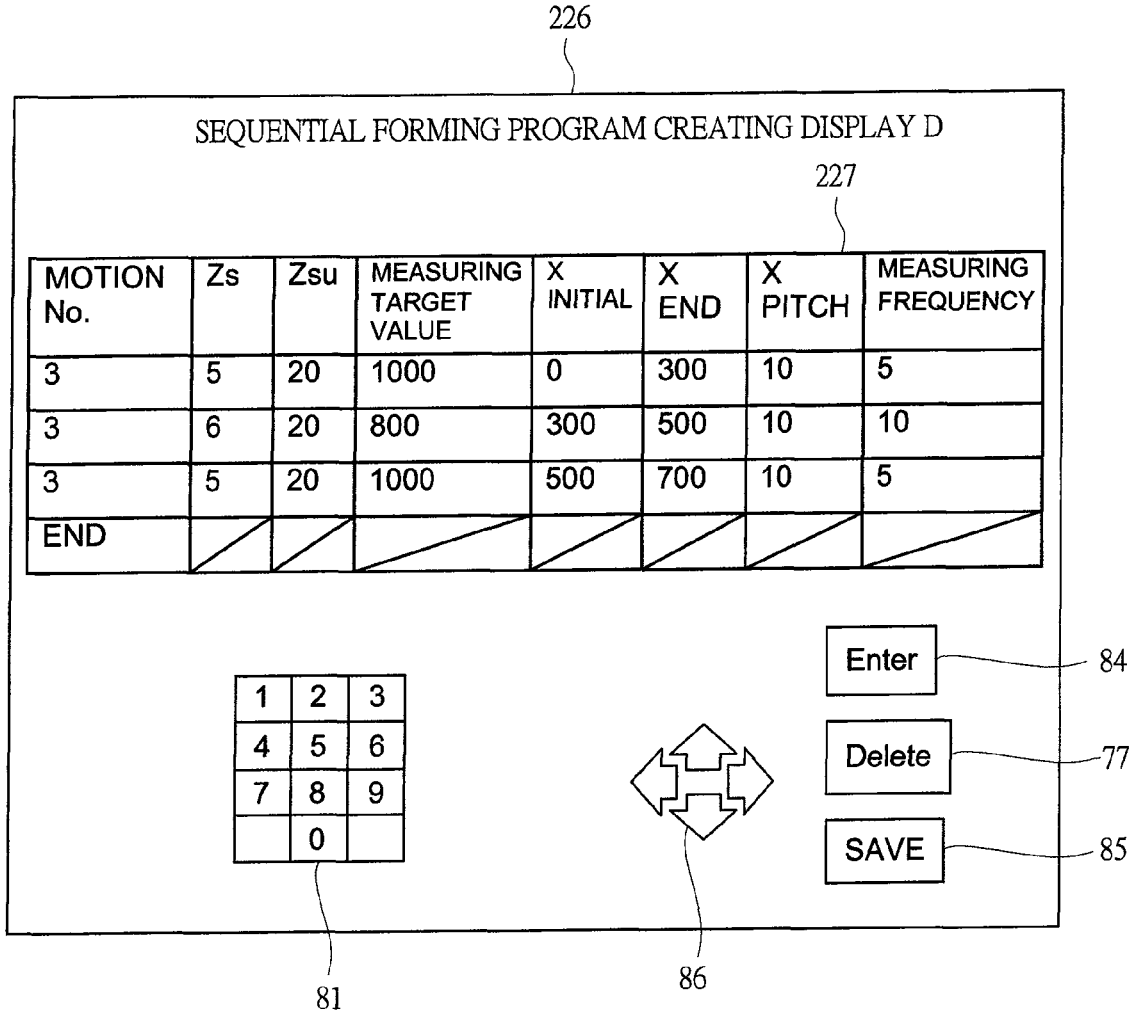

FIG. 35 is a flow chart illustrating an operation of the sequential-forging bending in the example forming method showing the effects of the present invention in the servo press according to the third embodiment of the present invention; and FIG. 36 is a view illustrating a sequential forming program creating display "D" in the example forming method showing the effects of the present invention in the servo press according to the second embodiment of the present invention.

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

[First Embodiment of the Present Invention]

<Summary of First Embodiment of the Present Invention>

In a controlling technique for a servo press, a first embodiment of the present invention is particularly applied to a controlling device for the servo press and a controlling method for the same which controls an electric servo press to control a slide position, and applied to a servo press equipped with the controlling device. In the technique, by measuring a springback magnitude, reaction force with respect to a die, and a sheet thickness of a workpiece during forming and installing the workpiece data into the controlling device for calculation, the slide position in a subsequent forming process for the same workpiece can be preferably changed, and forming precision can be improved.

A controlling device for a servo press is a controlling device which controls a servo press composed of: a frame; a bed; a bolster; a slide; a servo motor; and a conversion mechanism of rotational force to linear force, in accordance with a slide motion data (data in which time is described on a horizontal axis and a slide height is described on a vertical axis, and which determines a press operation). The controlling device includes: a slide-motion-data changing portion; and a measurement result receiving portion, and changes the slide motion data for forming the same workpiece, which is used after scheduled measuring time, in accordance with a slide-motion-data modification condition with using a measurement result of, for example, the springback magnitude, the sheet thickness, or the forming reaction force of the workpiece sent from the die.

Also, the servo press using the above-described controlling device is provided.

Further, a forming method for a metal workpiece has: a modified slide-motion-data calculation process for changing the slide motion data for the measurement process and a subsequent process, between a workpiece installing process and a workpiece extracting process for the same workpiece; and a progressive forming process for forming in accordance with the modified slide motion data, and the forming is carried out under an optimal condition for handling variability in a sheet thickness and material property of each workpiece.

Still further, the controlling device for the servo press has: a slide motion pattern entering portion; and a slide motion pattern creating portion, for newly adding a slide motion pattern with original slide motion data as described above.

Still further, in order to facilitate using the above-described advanced slide motion pattern also in other servo presses, the controlling device for the servo press has: a slide position command calculating portion; a motor speed commanding portion; and a memory portion for storing a slide-height/motor-rotation-angle correspondence table, and the controlling device sends a servo motor speed command to a servo amplifier of a servo motor using the slide-height/motor-rotation-angle correspondence table in accordance with a slide height command sent from the slide position command calculating portion.

Still further, in order to introduce the above-described high-function controlling device for a servo press at low cost, there are provided a motor of an existing mechanical press, a clutch thereof, a flywheel thereof, and a replaceable controlling device including: a slide position command calculating portion; a motor speed commanding portion; and a memory portion for storing the slide-height/motor-rotation-angle correspondence table, and sending a servo motor speed command to a servo amplifier of a servo motor with using the slide-height/motor-rotation-angle correspondence table in accordance with the slide height command sent from the slide position command calculating portion.

Hereinafter, the first embodiment based on the summary of the first embodiment of the present invention will be described in detail.

<Summary of Servo Press>

Figure 1:
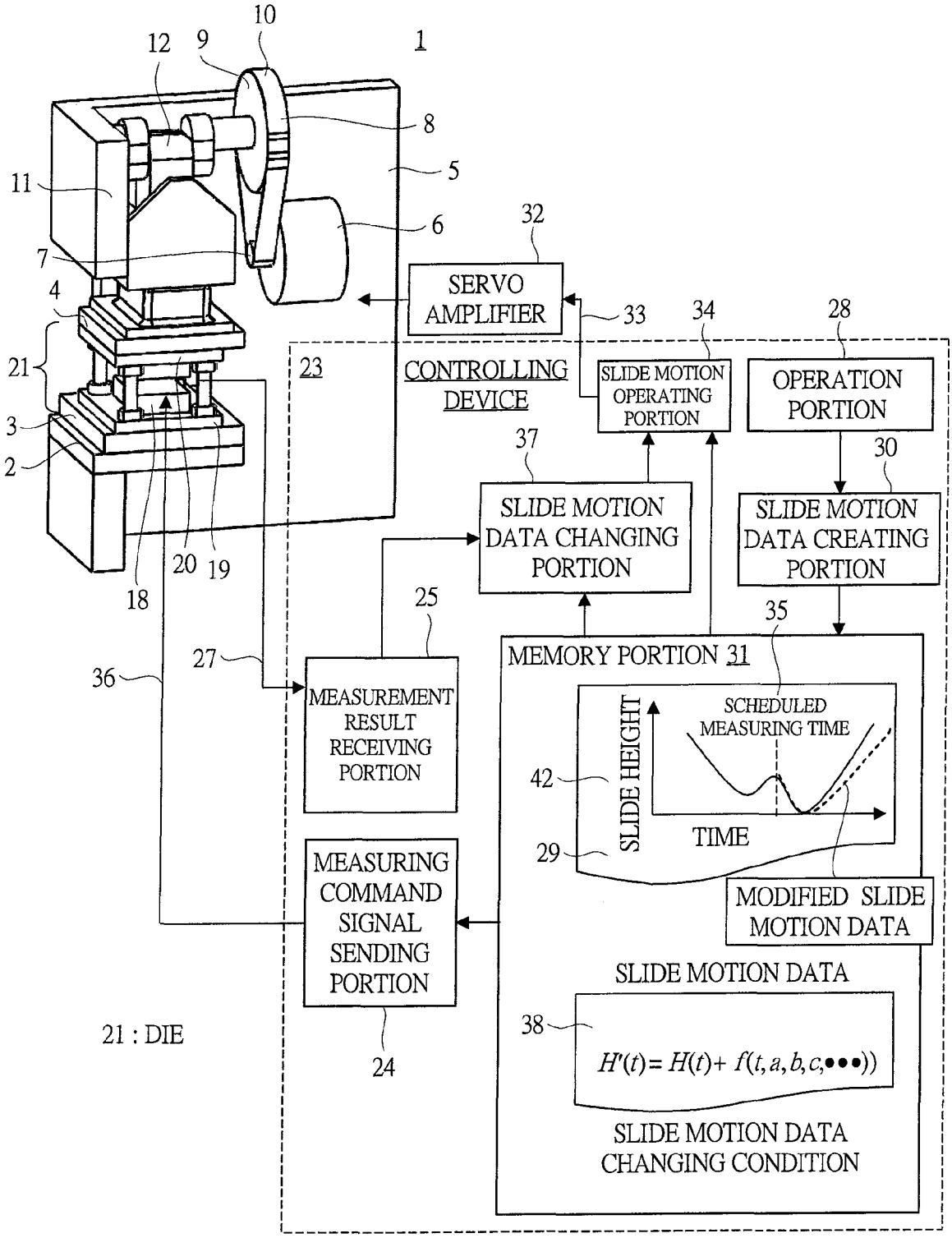
FIG. 1 is a diagram illustrating an example of a servo press according to a first embodiment of the present invention.

First, the summary of the servo press according to the first embodiment of the present invention will be described with reference to FIG. 1. FIG. 1 is a diagram illustrating an example of the servo press according to the present embodiment.

In a servo press 1 according to the present embodiment, a bed 2 is provided at a lower part of a front surface of a main body, and a bolster 3 is attached on an upper surface of the bed 2. Also, at a position opposed to the bolster 3, a slide 4 is attached on a frame 5 without any vertical move restraint. Further, a speed reducer 10 composed of a small pulley 7, a belt 8, and a large pulley 9 is joined with a servo motor 6 fixed to the frame 5.

The large pulley 9 of the speed reducer 10 is joined with a conversion mechanism 11 of rotational force to linear force, and the conversion mechanism 11 of rotational force to linear force is joined with the slide 4. In FIG. 1, the power of the servo motor 6 is increased via the small pulley 7, the belt 8, and the large pulley 9, and drives the conversion mechanism 11 of rotational force to linear force. A timing belt or the like is used as the belt 8. Also, the speed reducer 10 may be composed of a plurality of gears.

The conversion mechanism 11 of rotational force to linear force converts the rotational force of the servo motor 6 to the linear force, and drives the slide 4 in a vertical direction. In FIG. 1, as the conversion mechanism 11 of rotational force to linear force, a crank mechanism composed of: a crank axis 12 attached to the frame 5 without any rotational restraint; and a connecting rod is illustrated. However, the conversion mechanism is not limited to this. In addition to this, the present invention can be also applied to the conversion mechanism 11 of rotational force to linear force using a knuckle mechanism, a linkage mechanism, or a ball screw mechanism.

A workpiece 18 is subjected to forming by using a fixed die 19 attached onto the bolster 3 and a movable die 20 attached to the slide 4. The movable die 20 and the fixed die 19 are collectively called a die 21. Measurement equipment 22 (illustrated in FIG. 2) is attached in the die 21. The measurement equipment 22 is used as aiming at measuring variable factors of each workpiece, such as a sheet thickness and deformation resistance, with using a displacement sensor such as a contact displacement sensor, an optical displacement sensor, a laser optical displacement sensor, an electrostatic capacitance displacement sensor, and an eddy current displacement sensor, an image processing sensor composed of a camera and a calculating device, a pressure sensor, a load sensor such as a load cell, or others. The measurement equipment 22 is electrically connected with a measuring command signal sending portion 24 and a measurement result receiving portion 25 in a controlling device 23. A measurement result 27 such as a digital signal or an analog signal such as voltage, current, a resistance value outputted from the measurement equipment 22 is received by the measurement result receiving portion 25 in the controlling device 23.

A base structure of the controlling device 23 for the servo press 1 is composed of: an operation portion 28 for entering a forming condition; a slide motion data creating portion 30 for creating a slide motion data 29 based on the entered condition; a memory portion 31 for storing the slide motion data 29; and a slide motion operating portion 34 for reading the slide motion data 29 from the memory portion 31 and sending a speed command 33 to a servo amplifier 32. Here, the slide motion data 29 is a data in which time is described on one axis and a height of the slide 4 or a rotational angle of the crank axis 12 is described on the other axis or others.

The slide motion operating portion 34 is electrically connected with the servo amplifier 32, and the servo amplifier 32 is electrically connected with the servo motor 6. The slide motion operating portion 34 sends the velocity command 33 or a torque command to the servo amplifier 32 so as to drive the slide 4 in accordance with the description of the slide motion data 29. In accordance with the command of the slide motion operating portion 34, the servo amplifier 32 controls the servo motor 6 by adjusting the current flowing in the servo motor 6 so as to drive the slide 4.

Scheduled measuring time 35 is described in the slide motion data 29 used in the controlling device 23 for the servo press 1 according to the present embodiment. At the scheduled measuring time 35, a measuring command signal 36 is sent to the measurement equipment 22 attached in the die 21 for the measurement. In order to carry out the measurement, the controlling device 23 has: the measuring command signal sending portion 24 and the measurement result receiving portion 25 for receiving the measurement result 27 after the measurement. Also, a slide motion data changing portion 37 for changing the slide motion data 29 is composed of a central processing unit using a semiconductor device such as a microcomputer. The slide motion data changing portion 37 has a function for calculating a mathematical equation such as four arithmetic operation, power exponential function, trigonometric function, exponential function, logarithmic function, or piecewise polynomial. The slide motion data changing portion 37 may be configured as hardware in the same central processing unit as that of the slide motion data creating portion 30 and the slide motion operating portion 34 and may be independently operated as a software function, or the slide motion data changing portion 37 may be configured in a different central processing unit.

Based on the measurement result 27 loaded by the measurement result receiving portion 25 and a slide motion data changing condition 38 stored in the memory portion 31, the slide motion data changing portion 37 calculates and changes a slide motion data 29 device includes preferable after the scheduled measuring time 35.

<Details of Controlling Device>

Figure 2:
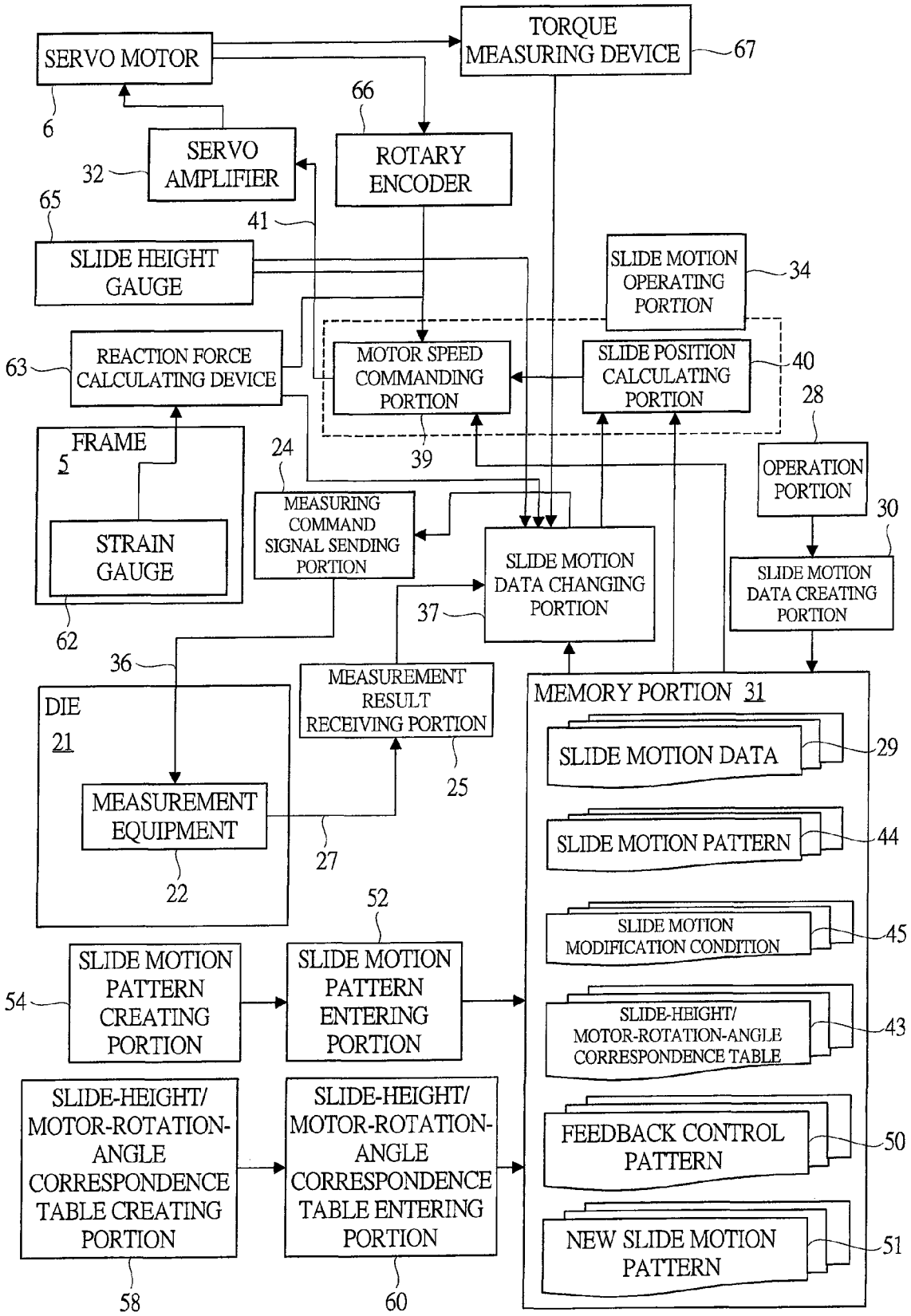
FIG. 2 is a diagram illustrating an example of a controlling device in the servo press according to the first embodiment of the present invention.

Next, details of the controlling device 23 will be described with reference to FIG. 2. FIG. 2 is a diagram illustrating an example of the controlling device in the servo press according to the present embodiment.

The slide motion operating portion 34 illustrated in FIG. 1 is composed of a motor speed commanding portion 39 and a slide position calculating portion 40 as illustrated in FIG. 2. The slide position calculating portion 40 sends a slide height command of the slide based on the slide motion data 29 to the motor speed commanding portion 39. The motor speed commanding portion 39 receives the slide height command, and sends different servo motor speed commands 41 from each other in accordance with differences of the servo motor 6 and the conversion mechanism 11 of rotational force to linear force which are used in the servo press 1. That is, when the reduction ratio of the speed reducer 10 is different or the conversion mechanism 11 of rotational force to linear force has a crank mechanism, a linkage mechanism, or a ball screw mechanism, the angle of rotation of the servo motor 6 is different even when the same slide height is commanded. The controlling device 23 for the servo press 1 according to the present embodiment has a structure capable of having the slide-height/motor-rotation-angle correspondence table 43 in the memory portion 31 and sending a preferable servo motor speed command 41 to the servo amplifier 32 so as to handle such a difference of the conversion mechanism 11 of rotational force to linear force, the servo motor 6, and the servo amplifier 32.

As the memory portion 31, a readable/writable memory (for example, a semiconductor RAM, flash memory, MRAM, hard disk drive, or Floppy (registered trade name) disk) is used. The slide motion data 29, a slide motion pattern 44, a slide motion modification condition 45, the slide-height/motor-rotation-angle correspondence table 43, or others are recorded in the memory portion 31.

Here, the slide motion pattern 44 is a common pattern data of the slide motion data 29 device includes previously prepared. For example, when it is desirable to carry out punching formation at high speed, the number of formation per time is increased even in the same servo press 1 by shuttling the slide 4 only in the vicinity of a dead bottom position. In this case, a desired slide motion data 29 can be created by, for example, selecting a pendulum pattern from the motion patterns 44 and entering two variables of the slide height and the strokes per minute of the conversion mechanism 11 of rotational force to linear force in the forming start and end. In addition to the pattern, the slide motion patterns 44 include: a rotation pattern for only rotating the servo motor 6 at a constant speed, a reciprocate pattern for reciprocating the slide in the middle of the process, a speed changing pattern for changing speed of the slide 4 in the middle of the process, and others. In addition to the conventional slide motion patterns 44, the controlling device 23 for the servo press 1 according to the present embodiment has a feedback control pattern 50 for changing the slide motion data 29 in accordance with the measurement result 27 sent from the die 21.

Also, the feedback control pattern 50 cannot be limited to one since the feedback control pattern is different depending on the used die 21 and measurement equipment 22. In the controlling device 23 for the servo press 1 according to the present embodiment, the memory portion 31 has a sufficient memory region to which various feedback control patterns 50 and the slide motion patterns 44 can be added later. Further, a slide motion pattern entering portion 52 and a slide motion pattern creating portion 54 are provided so that new slide motion pattern 51 can be newly added to the memory portion 31. The slide motion pattern creating portion 54 creates the new slide motion pattern 51, and the slide motion pattern entering portion 52 newly adds the created new slide motion pattern 51 to the memory portion 31.

The slide motion pattern entering portion 52 and the slide motion pattern creating portion 54 may be embedded in the controlling device 23, in an independent external computer, or others. If the slide motion pattern entering portion 52 and the slide motion pattern creating portion 54 are embedded in the controlling device 23, the created new slide motion pattern 51 may be directly stored in the memory portion 31 after the new slide motion pattern 51 is created. If the pattern is created by the external computer independent of the controlling device 23 or others, the new slide motion pattern 51 can be registered in the memory portion 31 in the controlling device 23 by using a storage medium (Floppy (registered trade name) disk, optical storage device, semiconductor memory) or others. Also, by installing a wired LAN (local area network), a wireless LAN, a phone line, or others to the controlling device 23, the new slide motion pattern 51 device includes created outside can be stored via a network.

The slide motion modification condition 45 is also stored in the memory portion 31. The slide motion data changing condition 38 is used in calculation of slide motion used after the scheduled measuring time 35 based on the feedback control pattern 50, and is composed of a mathematical equation such as four arithmetic operation, power exponential function, trigonometric function, exponential function, logarithmic function, or piecewise polynomial.

Also, the slide-height/motor-rotation-angle correspondence table 43 is a table describing the relation between the angle of rotation of the servo motor 6 and the slide height 42. When the die 21 and the slide motion data 29 manufactured for one servo press are used for another servo press, the correspondence table can absorb the difference of the servo motor 6 and the difference of the conversion mechanism 11 of rotational force to linear force, and it is facilitated to expand the same die and the same slide motion data to another device. The controlling device 23 has a slide-height/motor-rotation-angle correspondence table creating portion 58 and a slide-height/motor-rotation-angle correspondence table entering portion 60 so that the slide-height/motor-rotation-angle correspondence table 43 can also be added to the controlling device 23.

A strain gauge 62 is attached to the frame 5 of the servo press 1 according to the present embodiment, and reaction force generated in the forming is detected as strain of the frame 5 and is calculated by a reaction force calculating device 63, and then, the result is outputted to the motor speed commanding portion 39 to be used for adjusting the speed of the servo motor 6, and, at the same time, is outputted to the slide motion data changing portion 37 to be used for calculation in changing the slide motion data. Also, a slide height sensor 65 is composed of, for example, a linear gauge or others, and the height of the slide 4 is precisely measured and outputted to the motor speed commanding portion 39 to be used for adjusting the speed of the servo motor 6, and, at the same time, is outputted to the slide motion data changing portion 37 to be used for calculation in changing the slide motion data.

Further, in a rotary encoder 66 attached to the servo motor 6, the small pulley 7, the large pulley 9, or others, the angle of rotation is outputted to the motor speed commanding portion 39, so that the rotation speed of the servo motor 6 is precisely controlled. Still further, also in a torque measuring device 67 for measuring torque by measuring the excitation current of the servo motor 6 or others, the measured torque is outputted to the slide motion data changing portion 37 to be used for calculation in changing the slide motion data.

<Slide Motion Data Creating Portion of Controlling Device>

Figure 3:
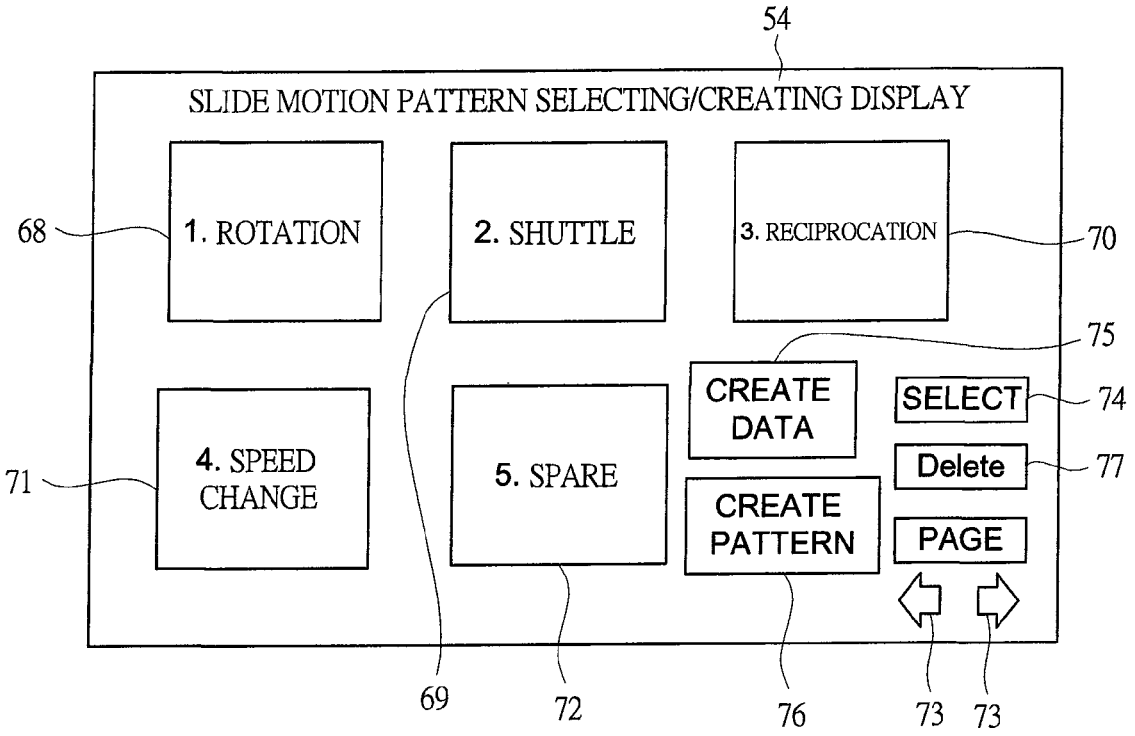
FIG. 3 is a view illustrating an example of a slide motion pattern selecting/creating display in the servo press according to the first embodiment of the present invention.
Figure 4:
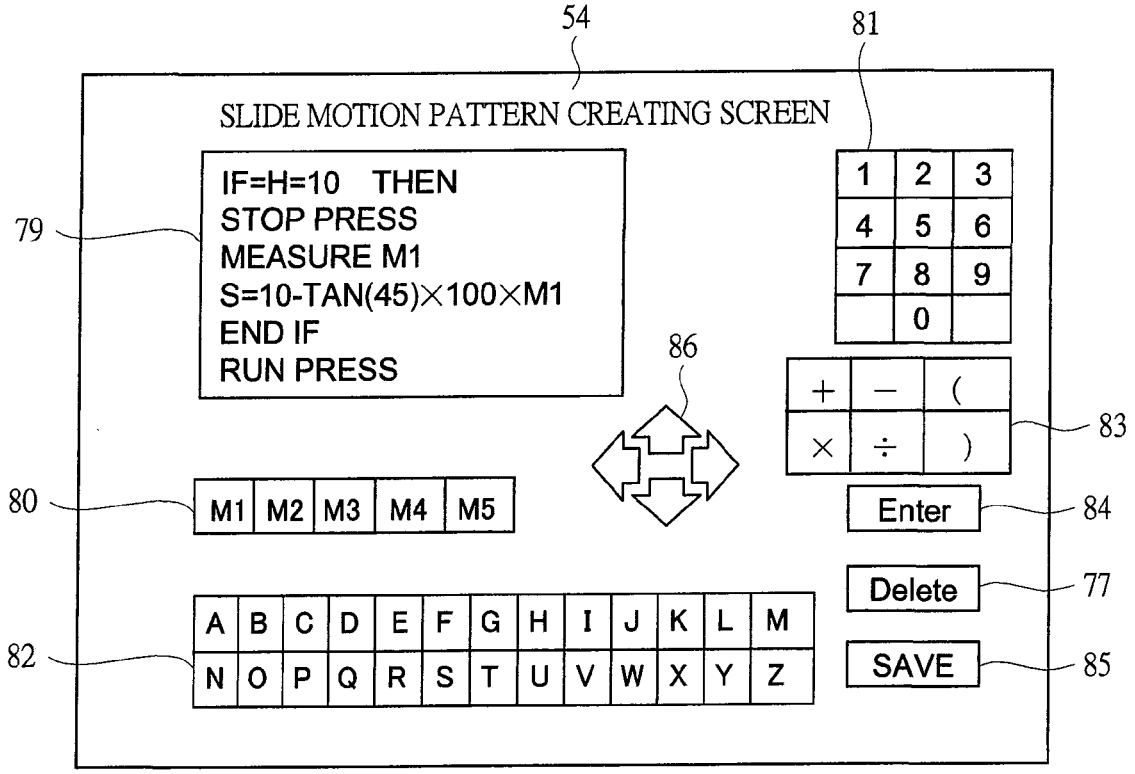
FIG. 4 is a view illustrating an example of a slide motion pattern creating display in the servo press according to the first embodiment of the present invention.

Next, the slide motion data creating portion 30 of the controlling device 23 according to the present embodiment is described with reference to FIGS. 3 and 4. FIG. 3 is a view illustrating an example of a slide motion pattern selecting/creating display. FIG. 4 is a view illustrating an example of a slide motion pattern creating display. The displays illustrated in FIGS. 3 and 4 have the structure in which an image displaying device such as a cathode-ray tube, liquid crystal, plasma panel, or organic EL is combined with a touch panel.

In the slide motion pattern selecting/creating display illustrated in FIG. 3, four motion patterns which are a rotation pattern display 68, a shuttle pattern display 69, a reciprocate pattern display 70, and a speed changing pattern display 71 are previously displayed, and a region for a spare pattern display 72 is secured so that at least one or more new slide motion patterns 51 can be added. Also, the slide motion pattern selecting/creating display is composed of two displays illustrated in FIGS. 3 and 4, and the new slide motion pattern 51 can be further added by movement to a forward or backward page with using a page key 73. In addition, a select key 74, a data create key 75, a pattern create key 76, and a delete key 77 are provided, and are used when new slide motion data is created based on the existing slide motion pattern 44, when the new slide motion pattern 51 is created, and when the slide motion pattern 44 device includes unnecessary is deleted. When the data create key 75 is pressed, the display is moved to the display illustrated in FIG. 4.

The slide motion pattern creating display illustrated in FIG. 4 is composed of: a slide motion modification condition displaying portion 79; an entered signal selection portion 80; a numerical keypad 81; a character input portion 82; an operation symbol input portion 83; an enter key 84; and a save key 85. By the entered signal selection portion 80, it is selected which measurement result 27 among signals received by the controlling device 23 is to be used. The slide motion data changing condition 38 is displayed in the slide motion modification condition displaying portion 79. In the slide motion data changing condition 38, the scheduled measuring time 35 and the used measurement result 27 are described. This display shows a condition by which, the slide 4 is stopped when the height is positioned as 10 mm away from the dead bottom position, the measuring command signal 36 is sent to the measurement equipment 22 corresponding to "M1", the measurement result 27 is received, the result is substituted into the variable, a slide lower limit height is calculated, and the servo amplifier 32 is operated again. The slide motion data changing condition 38 is inputted from the numerical keypad 81, the character input portion 82, and the operation symbol input" portion 83, and the condition is determined by the enter key 84, the condition is saved by the save key 85 if needed, and the condition is deleted by the delete key 77 if needed. A cursor is moved to each input item by a cursor key 86.

<Slide-Height/Motor-Rotation-Angle Correspondence Table Creating Portion of Controlling Device>

Figure 5:
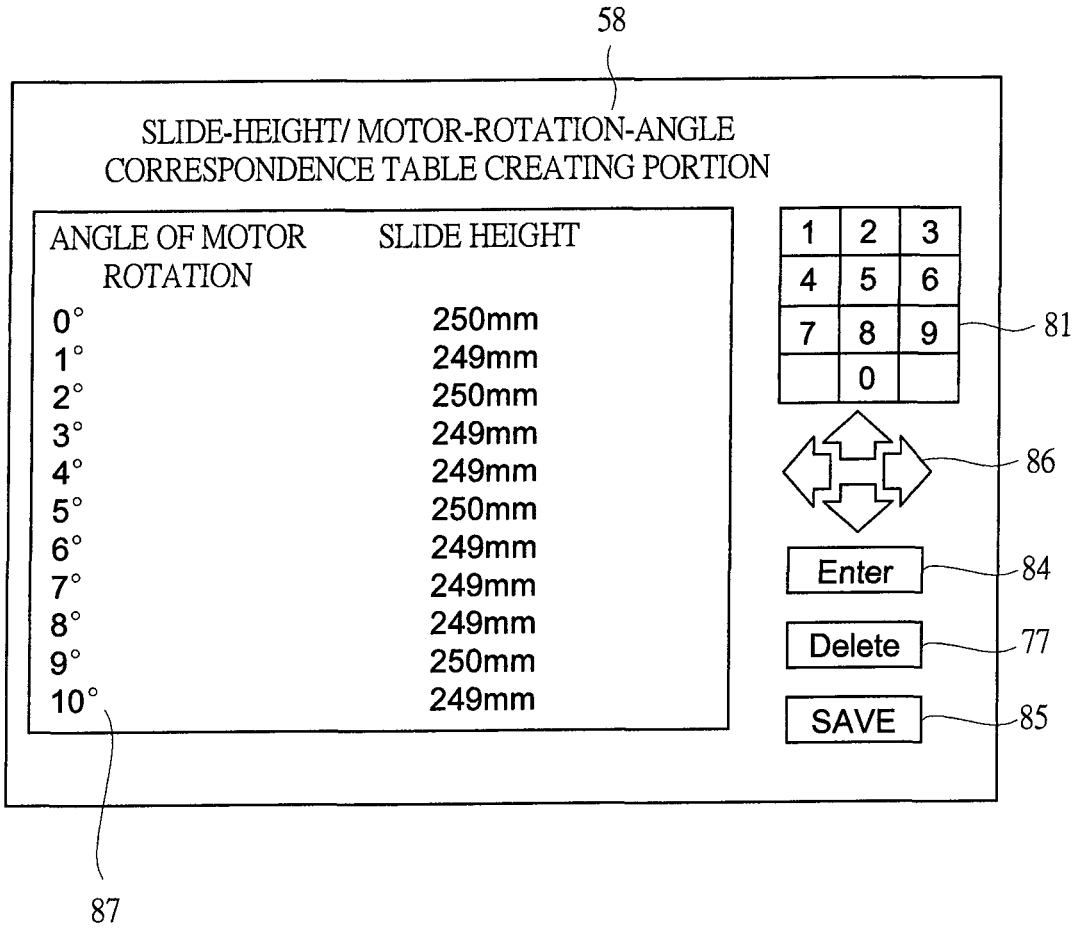
FIG. 5 is a view illustrating an example of a display for creating a slide-height/motor-rotation-angle correspondence table in the servo press according to the first embodiment of the present invention.

Next, an example of an inputting method in the slide-height/motor-rotation-angle correspondence table creating portion 58 of the controlling device 23 according to the present embodiment is described with reference to FIG. 5. FIG. 5 is a view illustrating an example of a creating display for the slide-height/motor-rotation-angle correspondence table. Similarly to the displays illustrated in FIGS. 3 and 4, the display illustrated in FIG. 5 also has the structure in which an image displaying device such as a cathode-ray tube, liquid crystal, plasma panel, or organic EL is combined with a touch panel.

The creating display of the slide-height/motor-rotation-angle correspondence table illustrated in FIG. 5 is composed of: the numerical keypad 81; a slide-height/motor-rotation-angle correspondence table displaying portion 87; the enter key 84; the save key 85; and the cursor key 86. The angles of rotation of the motor and their corresponding slide heights are described, and one described point and the other are connected with each other by an interpolation curve. The description is inputted by the numerical keypad 81, the description is determined by the enter key 84, the description is saved by the save key 85, and the description is deleted by the delete key 77. Also, a cursor is moved to each input item by the cursor key 86.

<Forming Method of Using Servo Press>

Figure 6:
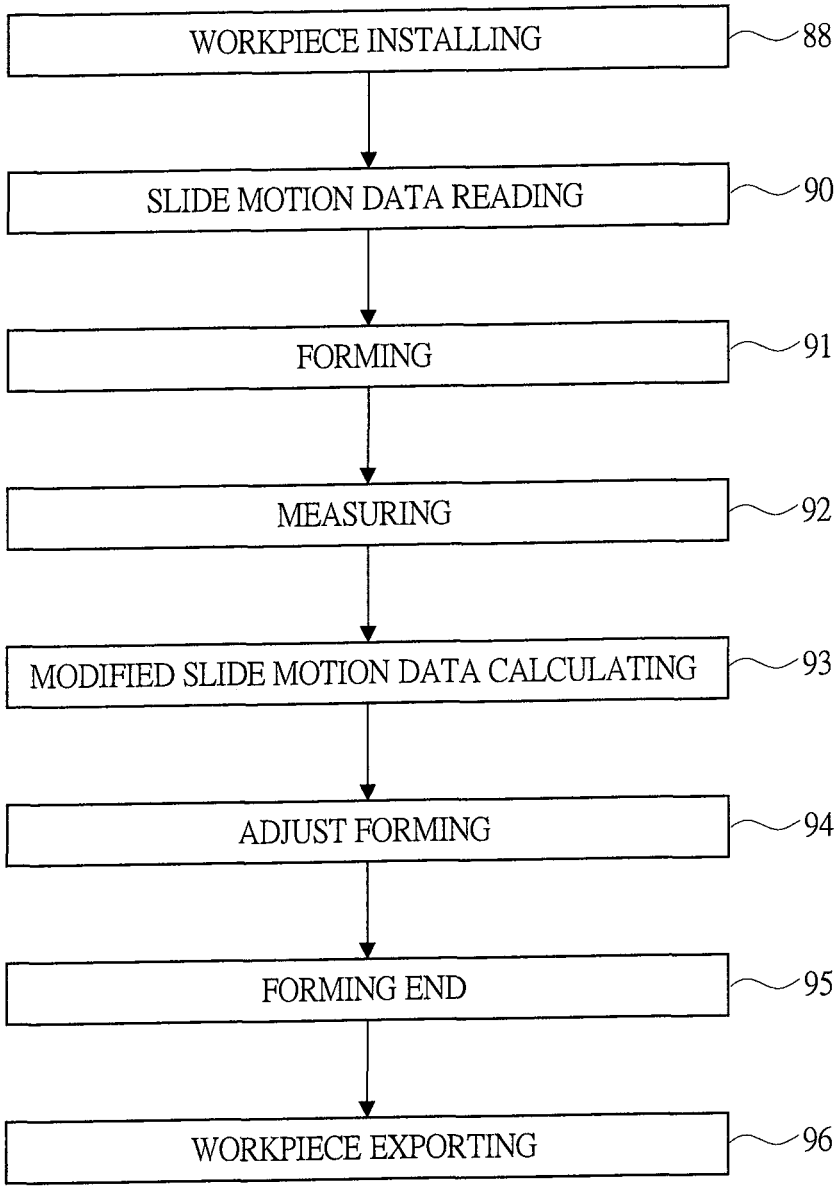
FIG. 6 is a flow chart illustrating an example of an operation of a forming method for using the servo press according to the first embodiment of the present invention.

Next, a forming method for using the servo press 1 according to the present embodiment is described with reference to a flow chart of FIG. 6. FIG. 6 is the flow chart illustrating an example operation of the forming method for using the servo press.

First, in a workpiece installing process 88, the workpiece 18 is installed between a movable die 20 attached to the slide 4 and a fixed die 19 attached to the bolster 3. The installation may be carried out manually or by a carrier device such as a robot which moves in synchronization with the servo press 1. Then, in a slide motion data reading process 90, the slide motion data 29 is read from the memory portion 31.

Subsequently, in a forming process 91, the workpiece 18 is subjected to the forming in accordance with the slide motion data 29. The slide 4 is temporarily stopped at the scheduled measuring time 35 described in the slide motion data 29. Then, in a measuring process 92, the measuring command signal 36 is sent from the measuring command signal sending portion 24 in the controlling device 23. The measurement result 27 sent from the measurement equipment 22 in the die 21 (including the movable die 20 and the fixed die 19) is received by the measurement result receiving portion 25 and is loaded into the controlling device 23.

Further, in a modified slide motion data calculation process 93, the slide motion data thereafter is changed in accordance with the measurement result 27 and the slide motion data changing condition 38. Then, in an adjust forming process 94, the forming is carried out in accordance with the changed slide motion data. Then, in a forming end process 95, the forming is ended. Finally, in a workpiece exporting process 96, the formed workpiece 18 is exported.

The above-described operation from the workpiece installing process 88 to the workpiece exporting process 96 is repeatedly executed for each workpiece 18.

<Hat Bended Part as Forming Target>

Figure 7:
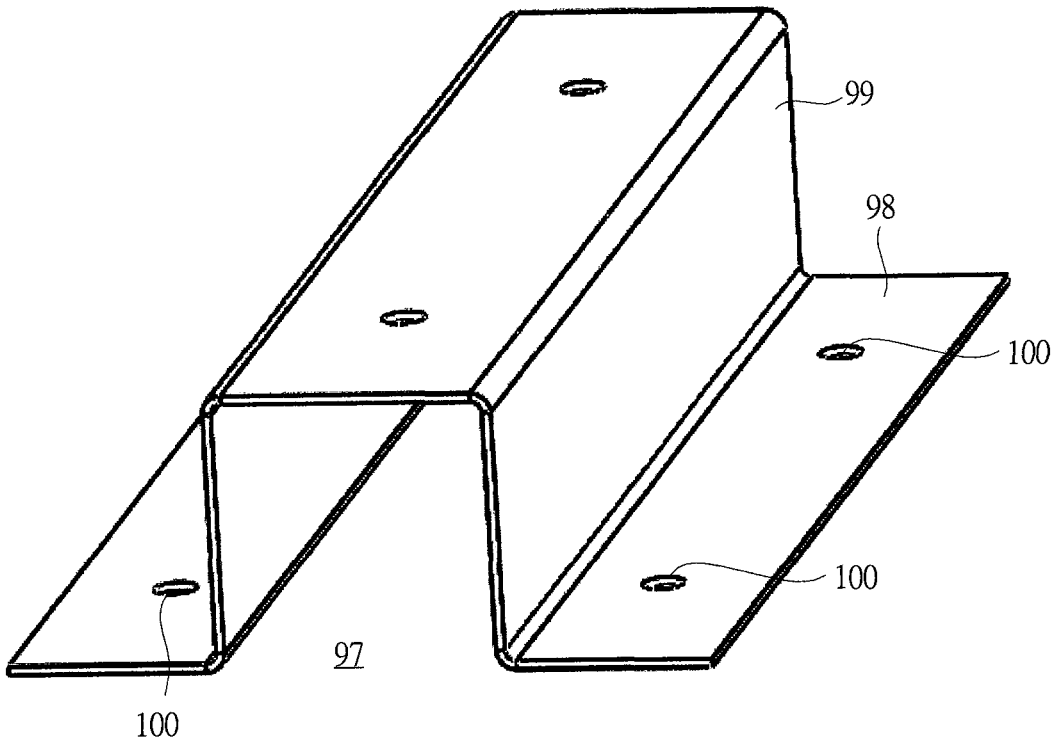
FIG. 7 is a view illustrating a hat bended part illustrating an example effect of the present invention in the servo press according to the first embodiment of the present invention.

Next, a high-precision forming method for using the controlling device 23 of the servo press 1 according to the present embodiment is described as targeting a hat bended part 97 illustrated in FIG. 7. FIG. 7 is a view illustrating the hat bended part showing an example effect of the present invention.

The hat bended part is widely used as a structural member assuming strength because a large section modulus can be obtained although the hat bended part is a light-weight part and the hat bended part has a bottom plane 98 which can be easily joined with a flat plate compared with a U-bent part. However, if the part is formed by using a press brake, productive efficiency is bad since a process for turning over a workpiece 18 is carried out twice in the middle of the forming. Therefore, the hat bended part 97 is formed by using a drawing die in many cases. However, in this case, since a side plane portion 99 is subjected to forming of bending once and reversely bending again to be flat, there arise a problem that large warpage is caused due to residual stress, and, since its thickness is reduced due to the reverse bending forming, there arises a problem that variability in its developed length are caused and the position stability of fastener holes 100 is reduced. Therefore, it is required to form the fastener holes 100 to be oversized and adjust the positions in bolt fastening, and it is required to use bolts and nuts by which the fastening can be carried out with tolerance of a relatively-loose hole diameter in product assembly, and therefore, a higher-efficient fastening method as using rivets cannot be employed.

By manufacturing with using the servo press 1 according to the present embodiment, the high-precisely hat bended part 97 can be manufactured, and assembly operation time can be significantly shortened.

<Hat-Bending Die>

Figure 8:
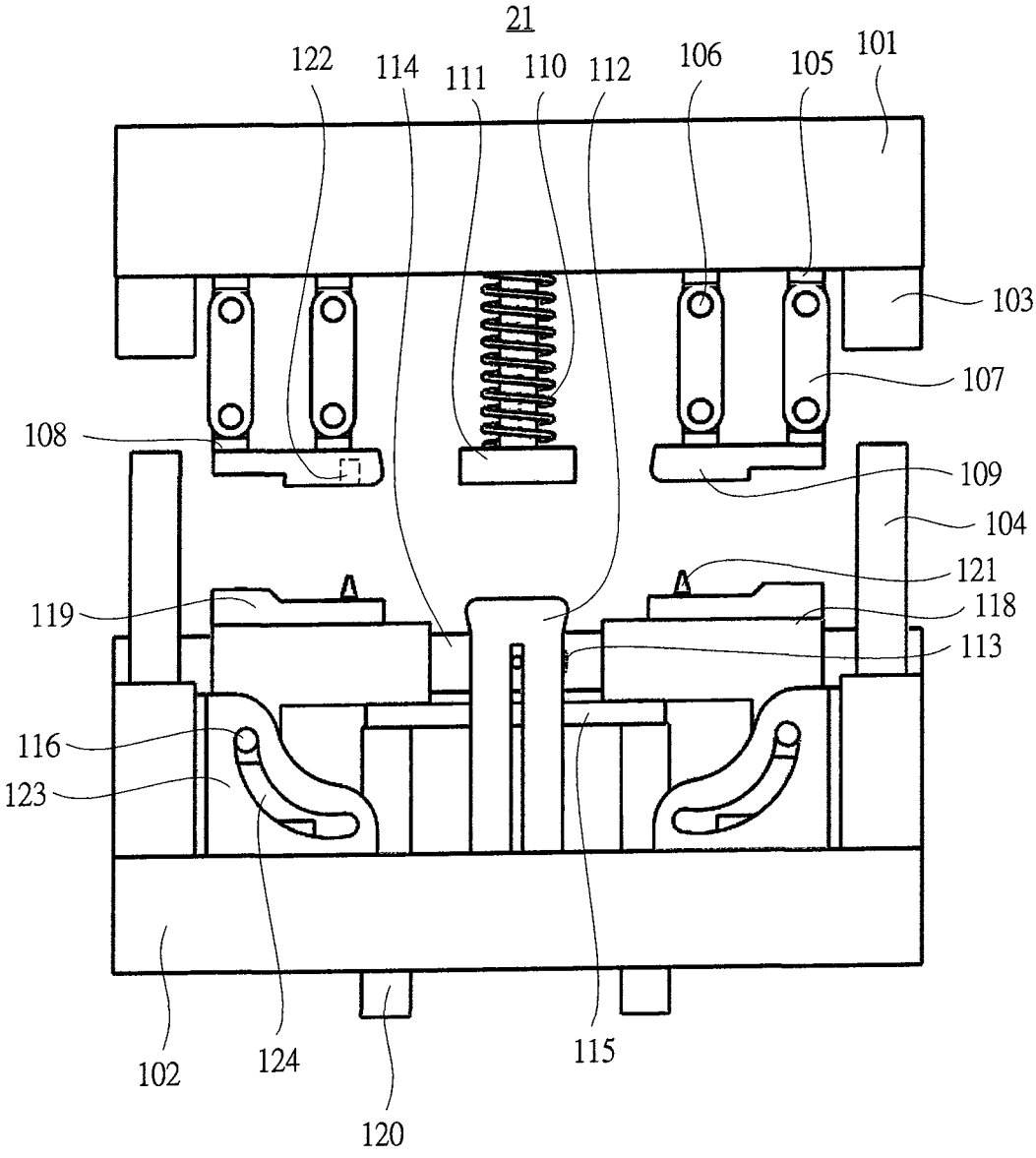
FIG. 8 is a view illustrating an example of a hat-bending die used in the forming by the servo press according to the first embodiment of the present invention.

Next, a highly accurate forming method for using the servo press 1 according to the present embodiment is described with reference to the hat-bending die 21 illustrated in FIG. 8. FIG. 8 is a view illustrating an example of the hat-bending die used in forming by the servo press.

In the die 21, an upper die set plate 101 corresponding to the movable die 20 is fixed to the slide 4 (not illustrated). A lower die set plate 102 corresponding to the fixed die 19 is fixed to the bolster 3 (not illustrated). A guide 103 fixed to the upper die set plate 101 and guide posts 104 fixed to the lower die set plate 102 are fixed so that both of them can move without vertical move restraint, and precision of vertical/lateral relative position of the upper die set plate 101 with the lower die set plate 102 is secured.

An upper hinge base 105 is attached to the upper die set plate 101, and a linkage part 107 is fixed thereto via a linkage pin 106 without rotational restraint. A lower part of the linkage part 107 is fixed to a lower hinge base 108 via the linkage pin 106 without rotational restraint. The lower hinge base 108 is fixed to an upper holding die 109. Three or more linkage parts 107 per one upper holding die 109 are disposed on a different line, so that the upper holding die 109 can be always paralleled to the upper die set plate 101. Also, an upper fixing die 111 is connected to the upper die set plate 101 via a spring 110. A lower punch die 112 is fixed to the lower die set plate 102. A displacement sensor 113 is attached to a side plane portion of the lower punch die 112. As the displacement sensor 113, contact type or non-contact type may be used. Here, the non-contact type eddy current displacement sensor 113 is used because of the balance between the measuring area and precision. The displacement sensor 113 receives the measuring command signal 36 from the measuring command signal sending portion 24 and sends the measurement result 27 to the measurement result receiving portion 25.

A hole is formed in the lower punch die 112 in a lateral direction, and a linear guide 114 is disposed in the hole. A cushion plate 115 is fixed below the linear guide 114. The cushion plate 115 is upwardly supported by a guiding rod 116. The guiding rod 116 is joined with a die cushion of the servo press 1 through a hole formed in the lower die set plate 102, and is always upwardly pushed by a constant load. Guiding plates 118 are fixed to the linear guide 114 without lateral move restraint so as to symmetrically sandwich the lower punch die 112 therebetween. A lower fixing die 119 is fixed on the guiding plate 118. By appropriately adjusting a length of a cushion pin 120, heights of an upper surface of the lower fixing die 119 and an upper surface of the lower punch die 112 are equalized to each other at an upper limit position of the die cushion.

A locator pin 121 is fixed to the lower fixing die 119. A locator hole 122 is formed at a position corresponding to the locator pin 121 in the upper holding die 109, so that there is provided a structure in which the workpiece 18 is sandwiched and lateral positions of the lower fixing die 119 and the upper holding die 109 are matched with each other during the forming. The guiding rod 116 is fixed to the guiding plate 118. The guiding rod 116 is inserted into a guiding curve 124 of a contour guide 123, and the guiding plate 118, the lower fixing die 119, and the upper holding die 109 are moved along the guiding curve 124 in the forming.

Figure 9:
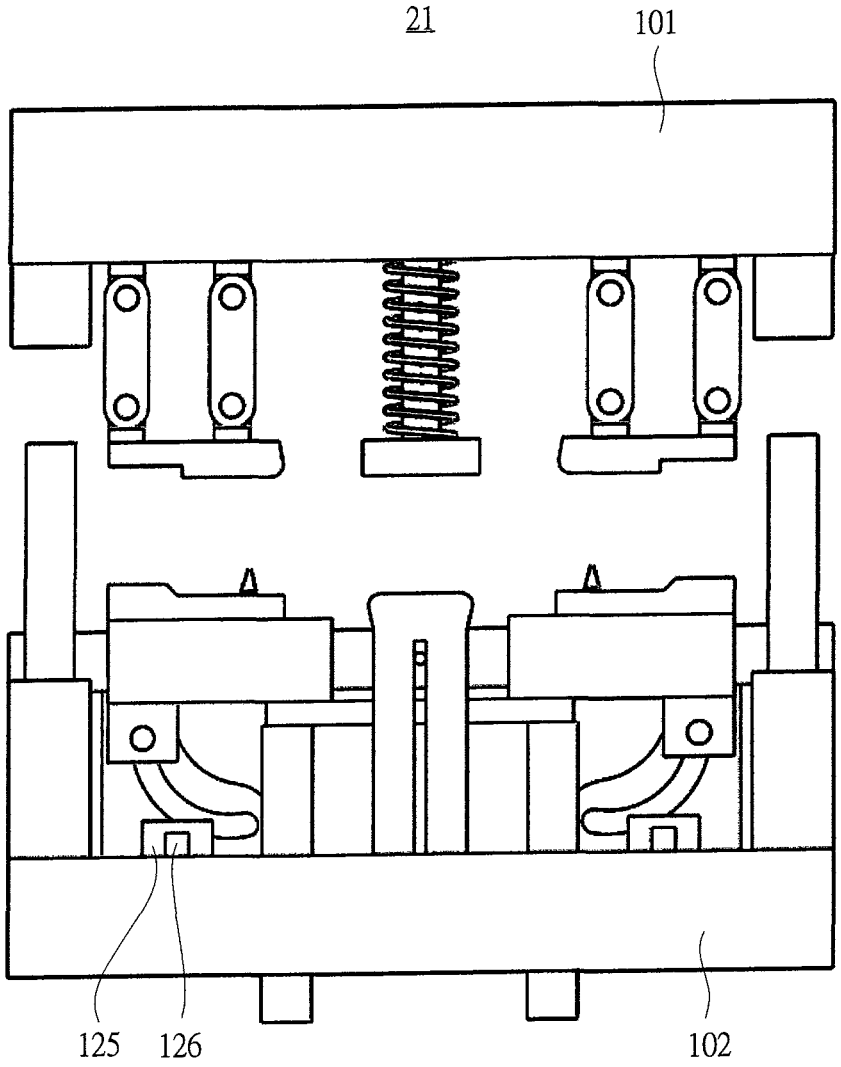
FIG. 9 is a view illustrating a rear surface of the hat bending die which is the example used in the forming by the servo press according to the first embodiment of the present invention.

Also, FIG. 9 is a view illustrating a rear surface of the hat-bending die 21. As illustrated in FIG. 9, a stopper 126 is attached without forward/backward restraint to a stopper guide 125 fixed to the lower die set plate 102, and can be driven forward and backward by an actuator (not illustrated) such as an air cylinder.

<Forming Method of Hat Bended Part>

Next, with reference to FIGS. 10 to 16, a forming method of high-precisely forming the hat bended part 97 with using the servo press 1 according to the present embodiment is described. If needed, the names of the processes illustrated in FIG. 6 are referenced.

Figure 10:
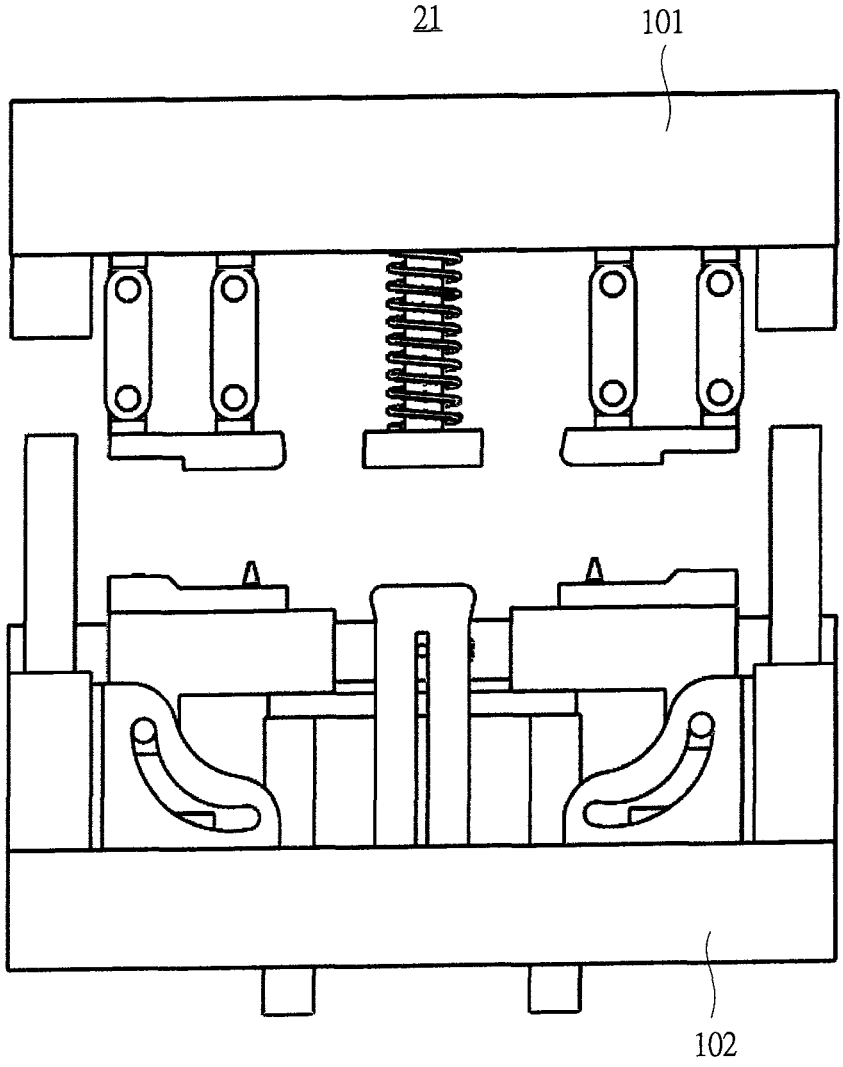
FIG. 10 is a view illustrating a standby state before importing a workpiece in an example forming method showing the effects of the present invention in the servo press according to the first embodiment of the present invention.

FIG. 10 is a view illustrating a standby state before installation of the workpiece in an example forming method showing effects of the invention. A state of the normal die 21 is a standby state in which the slide 4 (not illustrated) fixed to the upper die set plate 101 is at a dead top position.

Figure 11:
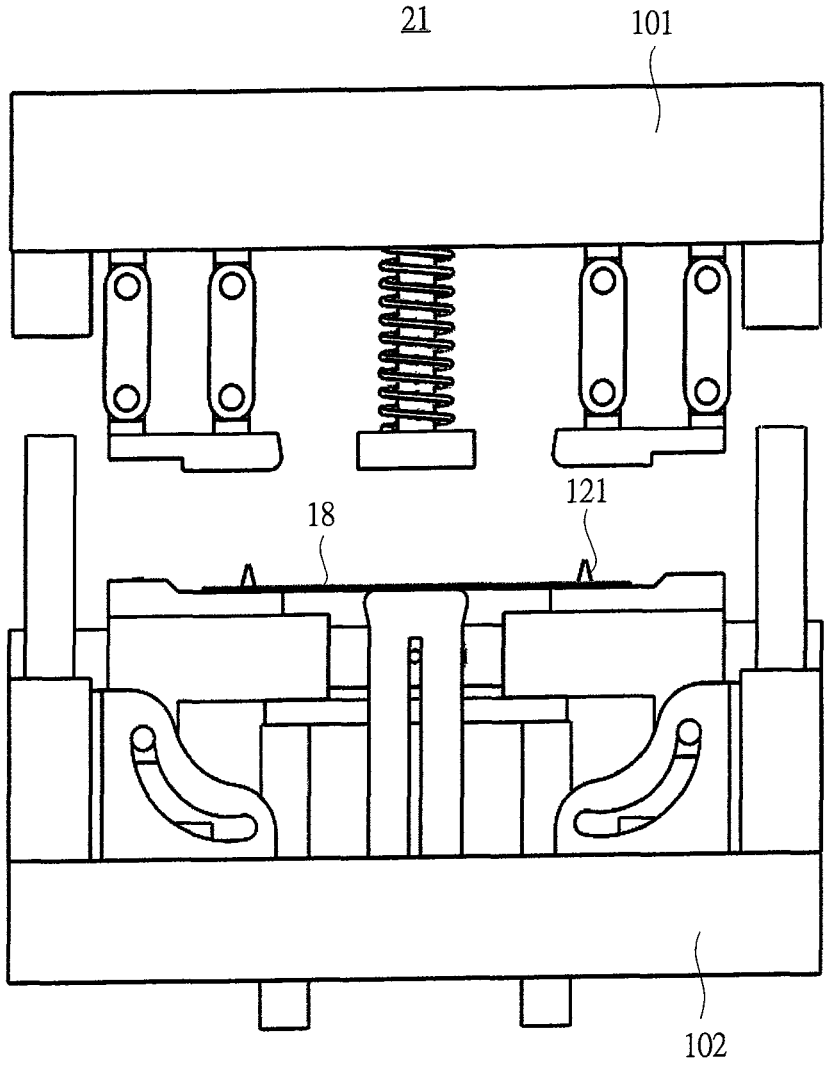
FIG. 11 is a view illustrating a workpiece installing process in the example forming method showing the effects of the present in the servo press according to the first embodiment of the present invention.

FIG. 11 is a view illustrating the workpiece installing process 88. In this process, after forming the workpiece 18, the workpiece 18 is disposed at a right position by inserting the locator pin 121 into the hole to be the fastener hole 100 of the hat bended part 97. At this time, it is desirable to form a diameter of the locator pin 121 so as to be smaller than a diameter of the fastener hole 100. Preferably, the diameter of the locator pin 121 is smaller than the diameter of the fastener hole 100 by about 1 mm. Also, a lateral distance between centers of the locator pins 121 in the state of FIG. 11 is smaller than a distance between center positions of the fastener holes 100 of the workpiece 18 by 2 mm. In this manner, even if the lateral distance from the center of the locator pin 121 and the distance from the center position of the fastener holes 100 of the workpiece 18 are different from each other, the workpiece 18 can be precisely positioned when the workpiece 18 is disposed in the die 21.

Figure 12:
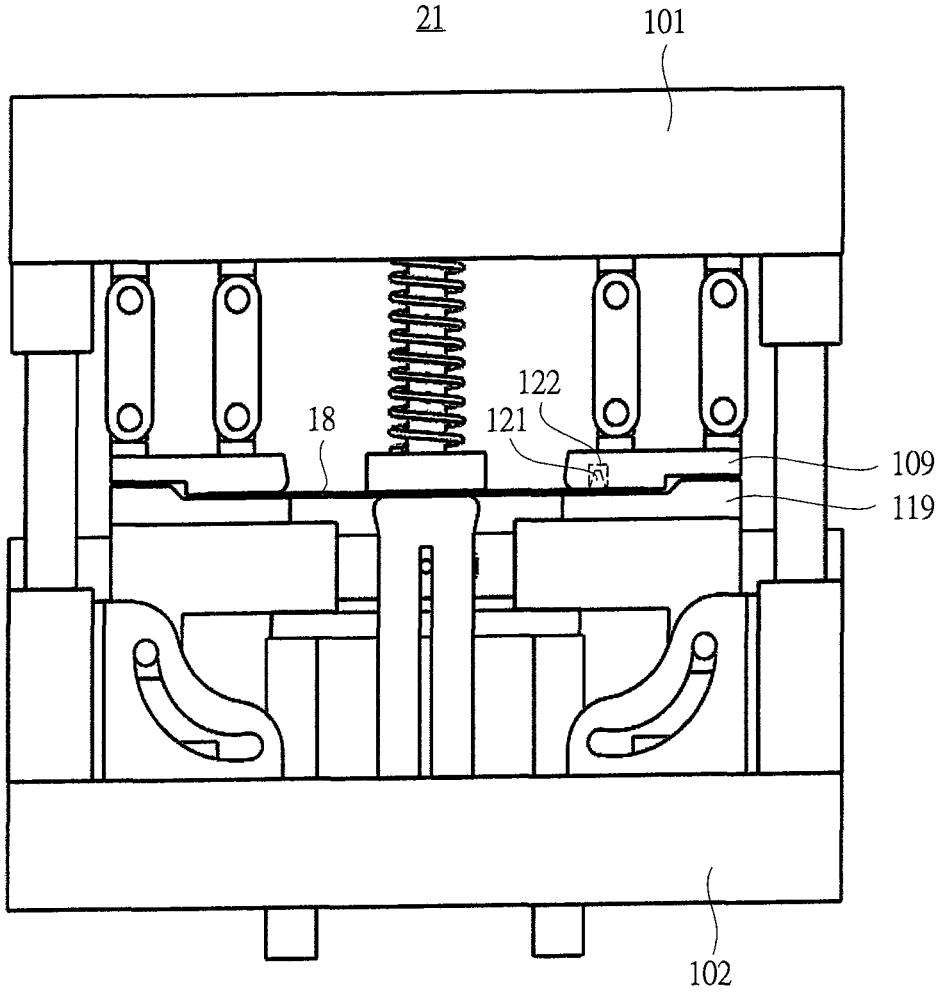
FIG. 12 is a view illustrating a state that the workpiece is interposed, in the middle of a forming process of the example forming method showing the effects of the present invention in the servo press according to the first embodiment of the present invention.

Subsequently, in the slide motion data reading process 90, the slide motion data 29 used in the forming is read and the forming process 91 is started. FIG. 12 is a view illustrating a state that the workpiece 18 is sandwiched in the middle of the forming process 91, device includes a state that the workpiece 18 is sandwiched by the upper holding die 109 and the lower fixing die 119 in the middle of the forming process 91. At this time, the upper holding die 109 and the lower fixing die 119 are connected with each other by the locator pin 121 and the locator hole 122, and therefore, their lateral movement is matched with each other in the subsequent forming process 91. Also, the upper holding die 109 receives downward compression force from the slide 4, and the lower fixing die 119 receives the upward pushing force of the die cushion, and therefore, lateral movement of the workpiece 18 becomes equal to that of the lower fixing die 119 by the friction force therebetween.

Figure 13:
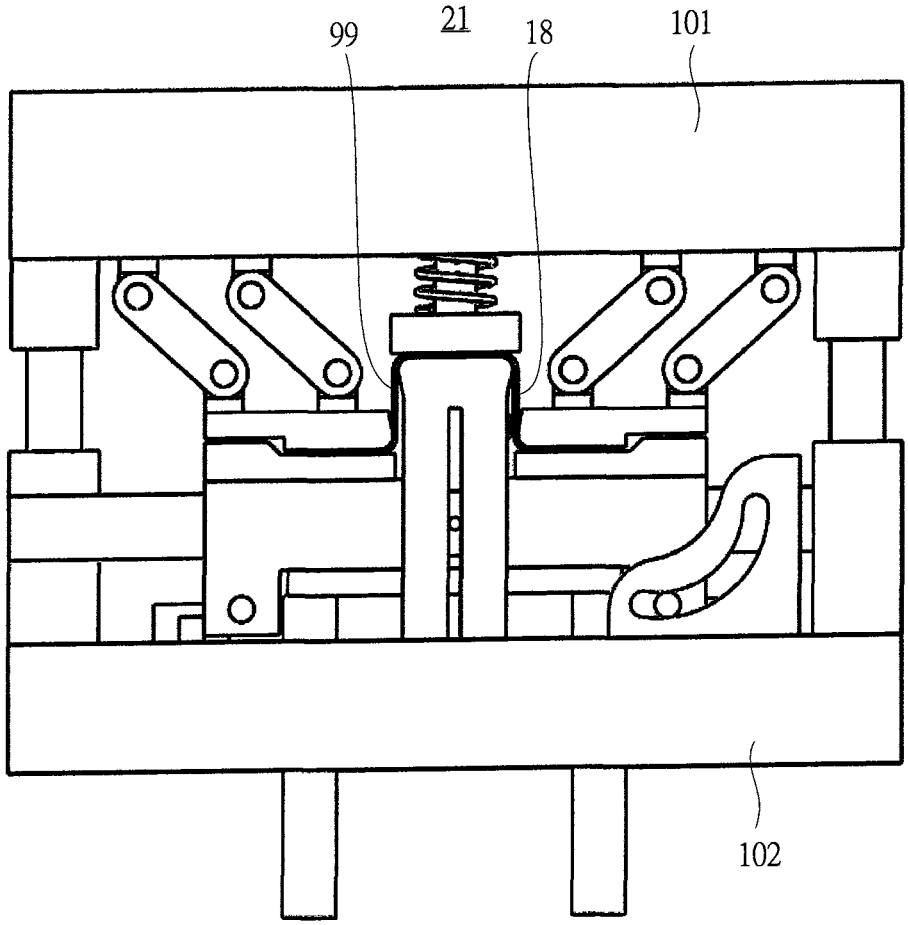
FIG. 13 is a view illustrating a slide-stop state in the forming process of the example forming method showing the effects of the present invention in the servo press according to the first embodiment of the present invention.

Then, the height of the slide 4 is determined by the slide motion data 29, and the operation of the slide 4 is stopped at a moment when the slide 4 reaches a height at the scheduled measuring time 35. An angle of the side plane portion 99 of the workpiece 18 at this time is preferably close to a final target angle. FIG. 13 is a view illustrating a slide stop state of the forming process 91, and the slide 4 is stopped at a moment when the angle of the side plane portion 99 of the workpiece 18 becomes 90°.

Figure 14:
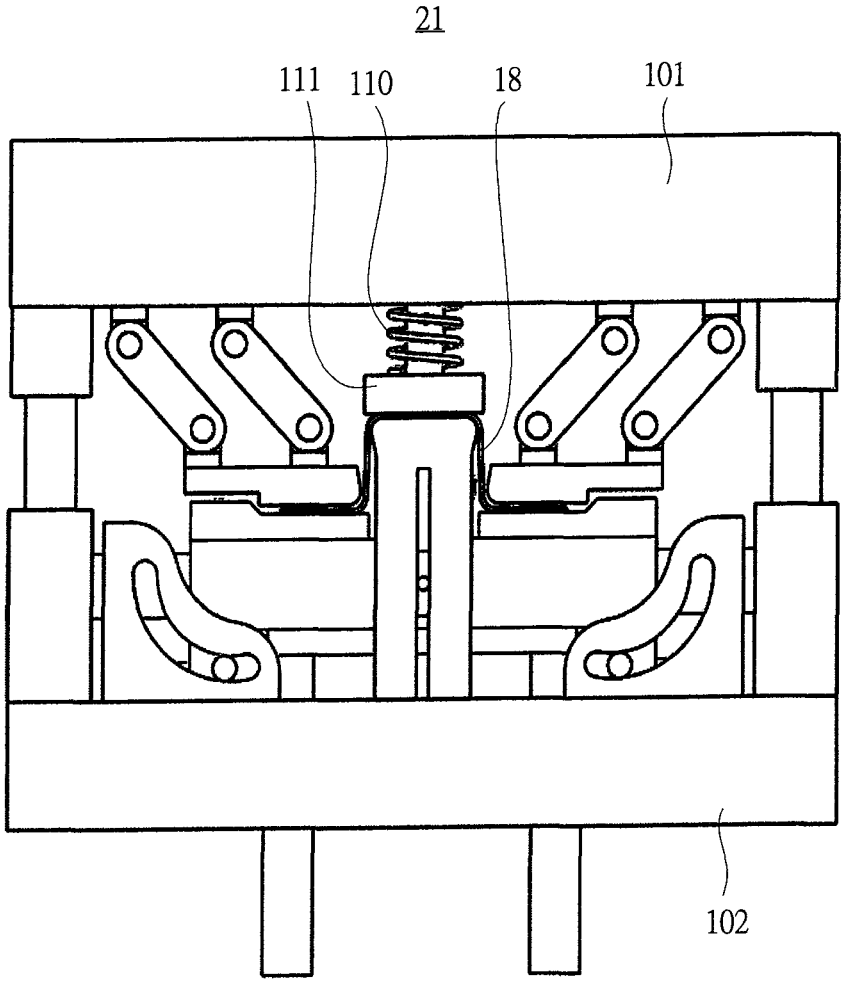
FIG. 14 is a view illustrating a measuring process in the example forming method showing the effects of the present invention in the servo press according to the first embodiment of the present invention.
Figure 17:
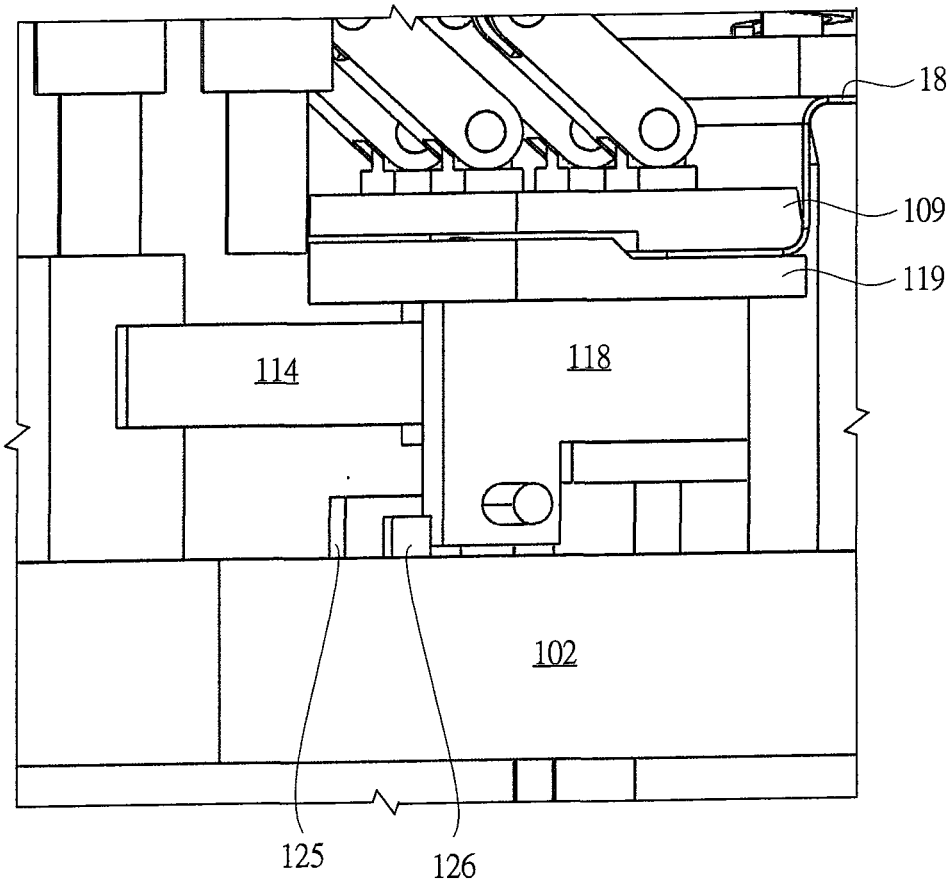
FIG. 17 is a view illustrating a stopper-guide function in the example forming method showing the effects of the present invention in the servo press according to the first embodiment of the present invention.

Then, the measuring process 92 is carried out. FIG. 14 is a view illustrating the measuring process 92. A view of illustrating a detailed stopper function of FIG. 14 is FIG. 17. As illustrated in FIGS. 14 and 17, the stopper 126 is driven and is contacted with the lateral surface of the guiding plate 118, so that the lower fixing die 119 is fixed by the force of the die cushion so as not to move the lower fixing die 119 up. Further, the slide 4 is slightly moved up, so that the springback magnitude of the workpiece 18 can be measured. At this time, since downward force is applied to the upper fixing die 111 by the force of the spring 110, the workpiece 18 is not displaced. In the measuring process 92, the measuring command signal 36 is sent from the measuring command signal sending portion 24 for the controlling device 23 to the measurement equipment 22. The measurement equipment 22 sends the measured result as the measurement result 27 to the measurement result receiving portion 25 of the controlling device 23. In the modified slide motion data calculation process 93, the slide motion data changing portion 37 of the controlling device 23 changes the slide motion data 29 used after the scheduled measuring time 35 in accordance with the measurement result 27 and the slide motion data changing condition 38.

Figure 15:
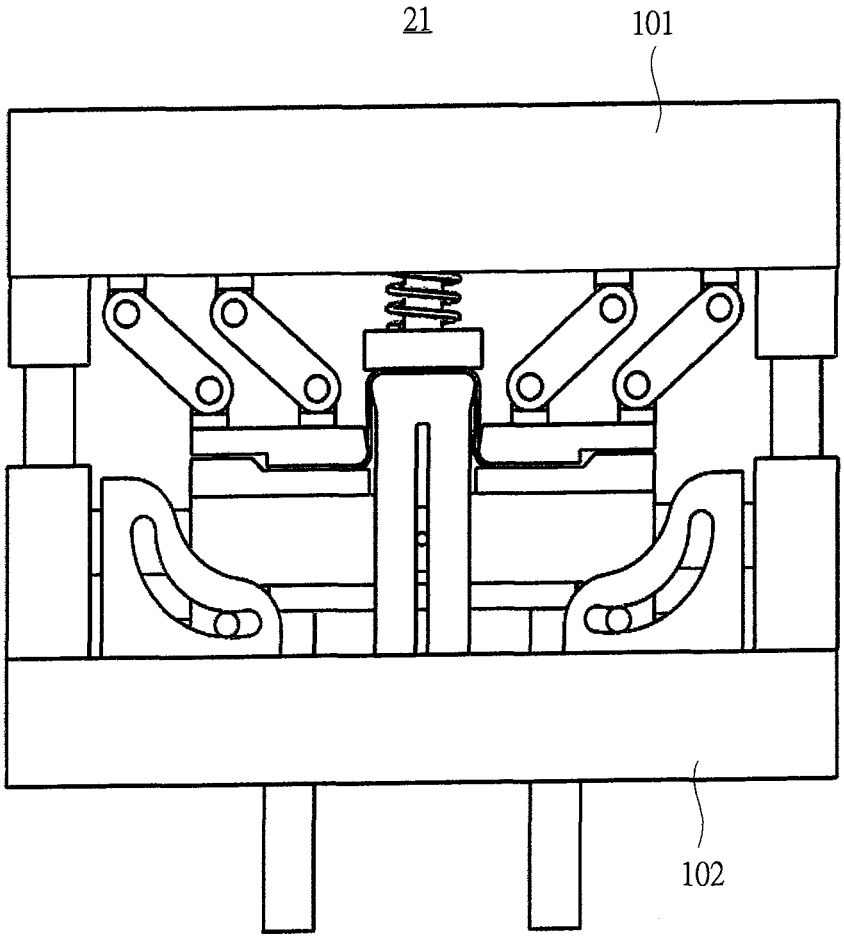
FIG. 15 is a view illustrating an adjust-forming process in the example forming method showing the effects of the present invention in the servo press according to the first embodiment of the present invention.
Figure 16:
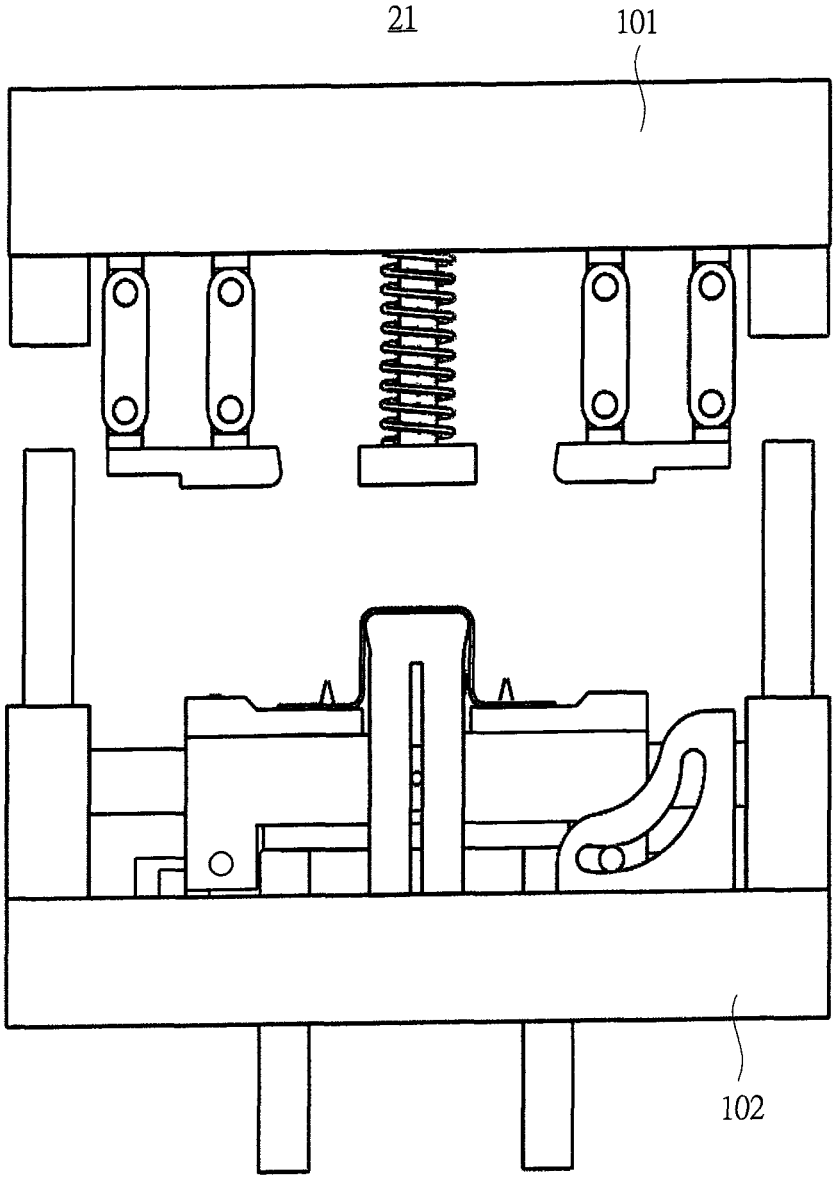
FIG. 16 is a view illustrating a forming end process in the example forming method showing the effects of the present invention in the servo press according to the first embodiment of the present invention.

Subsequently, the adjust forming process 94 is carried out. FIG. 15 is a view illustrating the adjust forming process 94. As illustrated in FIG. 15, in the adjust forming process 94, the adjust forming as taking the springback magnitude into consideration is carried out in accordance with the slide motion data 29. Then, the process proceeds to a forming end process 95. FIG. 16 is a view illustrating the forming end process 95. As illustrated in FIG. 16 (see FIG. 17 for details), in the forming end process 95, the slide 4 to which the upper die set plate 101 is fixed returns to the dead top position. In this state, the stopper 126 fixes the guiding plate 118. In the workpiece exporting process 96 at the end, the formed workpiece 18 is taken out, and the stopper 126 is returned to the original position, so that the lower fixing die 119 is moved up, the state returns to the standby state illustrated in FIG. 10, and the forming of the hat bended part 97 is finished.

In the above-described embodiment, the scheduled measuring time 35 is set at a moment when the side plane portion 99 of the workpiece 18 is bent by an angle of 90°. Therefore, the slide motion data 29 is changed so that the height as taking the springback magnitude obtained in the measuring process 92 into consideration is at the forming end of the slide 4. An angle of the linkage part 107 at this time is substantially 45°. Therefore, a descending length of the slide 4 and a lateral movement distance of the lower fixing die 119 are almost equal to each other. Therefore, the descending length of the slide 4 in the adjust forming process 94 is equal to the springback magnitude obtained in the measuring process 92.

<Effects and Application Examples of the Present Embodiment>

According to the present embodiment described above, the controlling device changes the slide motion data 29 for forming the same workpiece 18 at the scheduled measuring time 35 in accordance with the measurement result 27 sent from the measurement equipment 22 attached to the die 21, so that the optimal forming for handling the variabilities in the sheet thickness and material property of the workpiece 18 and for handling each workpiece 18 can be achieved. As a result, precision and quality of a formed product such as the hat bended part 97 can be improved.

Also, since the slide motion pattern 44 which is original of the slide motion data 29 and the slide-height/motor-rotation-angle correspondence table 43 can be newly added, their usage in other servo presses can also be facilitated, and further, the controlling device 23 for a highly-functional servo press can be introduced at low cost.

The above-described embodiment describes the method in which the springback magnitude is directly measured in the measuring process 92, and the magnitude is subjected to the adjust forming. In this forming method, it is required to temporarily release the workpiece 18 in order to measure the springback magnitude, and the structure of the die 21 is complicated. It is known that the variabilities in the springback magnitude are caused by variability in the sheet thickness and the yield stress. Therefore, in the measuring process 92, quantity identifying these two variables is measured, and the slide motion data changing condition 38 for changing the slide motion data 29 is created based on the quantity, so that the forming can be achieved without releasing the workpiece 18 in the measuring process 92, displacement of the workpiece 18 due to re-grasping thereof can be prevented, and further, the structure of the die 21 can be simplified.

Also, for the slide motion data changing condition 38, a generally-known theoretical formula for obtaining the springback magnitude caused in bending a metal thin plate may be applied, or, a linear or non-linear experimental formula which shows good approximation of the springback magnitude obtained by the sheet thickness and the yield stress as the variables may be created and used based on actual forming results in neighborhood of the measuring process.

Further, as the method for measuring the sheet thickness, there is a method for measuring a gap between the upper fixing die 111 and the lower punch die 112 or a gap between the upper holding die 109 and the lower fixing die 119. Still further, the yield stress can be calculated base on measurement for the reaction force caused by the workpiece 18. Still further, without the yield stress, the slide motion data changing condition 38 may be created by direct calculation from the measured reaction force. The reaction force of the workpiece 18 may be obtained by a method for calculating difference between the reaction force caused at the upper holding die 109 and the reaction force caused at the lower fixing die 119, the reaction force caused at the upper holding die 109 being calculated by the reaction force calculating device 63 from the torque of the servo motor 6 measured by the torque measuring device 67 or the strain of the strain gauge 62 attached to the frame 5, and the reaction force caused at the lower fixing die 119 being calculated from the pressure caused at the die cushion, with using the hardware already attached to the press.

Still further, in order to measure the reaction force caused from the workpiece 18 with higher precision, a pressure meter, a load cell, a load meter, a strain gauge, or the like may be attached in the die 21 for the measurement.

In the present embodiment, the effects of the present invention are described by exemplifying the high precision in the hat bend forming as an example. However, application of the present invention is not limited to the scope of this.

Also, the case of directly measuring the springback magnitude and the method for indirectly obtaining the springback magnitude from the sheet thickness and the reaction force caused in the forming are described above. However, these two cases have different slide motion patterns 44 from each other. In the forming method for using the servo press 1 in high level as the present invention, it is difficult to handle the cases only by the slide motion pattern 44 prepared by a press manufacturer in sales. Therefore, the controlling device 23 according to the present embodiment includes the memory portion 31 having a sufficient capacitance so that the slide motion pattern 44 can be added later, and includes the slide motion pattern entering portion 52 and the slide motion pattern creating portion 54.

Moreover, in the controlling device 23 according to the present embodiment, the slide-height/motor-rotation-angle correspondence table 43 is stored in the memory portion 31 so that the slide motion pattern 44 and the slide motion data 29 created by spending a lot of man-hours can be easily used also for other servo presses 1, and the controlling device 23 includes the slide-height/motor-rotation-angle correspondence table creating portion 58 and the slide-height/motor-rotation-angle correspondence table entering portion 60 so that the slide-height/motor-rotation-angle correspondence table 43 can be newly created and added. In accordance with the slide height command outputted from the slide position command calculating portion 40, the motor speed commanding portion 39 calculates a preferable command matched in the slide-height/motor-rotation-angle correspondence table 43, and sends the command to the servo amplifier 32.

The controlling device 23 according to the present embodiment has the structure easily capable of handling the differences in the conversion mechanism 11 of rotation force to linear force and the servo motor 6 of the servo press 1 as described above. Therefore, when the controlling device 23 according to the present embodiment and the servo motor 6 are employed, the functions equivalent to those of a newly-purchased servo press 1 can be obtained at lower cost by removing the motor, flywheel, and clutch of an existing mechanical press and attaching the servo motor 6 and the controlling device 23 according to the present embodiment.

[Second Embodiment of the Present Invention]

<Summary of Second Embodiment of the Present Invention>

A second embodiment of the present invention describes an example that the invention is applied to sequential-bending forming instead of the hat bending forming of the above-described first embodiment. In the second embodiment of the present invention, a controlling device for a servo press is a controlling device for the sequential forming, of controlling the servo press in accordance with a slide motion data, the servo press being composed of: a frame; a bed; a bolster; a slide; a servo motor; and a conversion mechanism of rotational force to linear force. The controlling device includes: a slide motion data changing portion; a measurement result receiving portion; and a die actuator drive command sending portion, and the slide motion data of forming the same workpiece is changed at scheduled measuring time in accordance with a measurement result sent from the die, and a slide motion for adjust forming is carried out to one workpiece a plurality of times.

Hereinafter, a second embodiment based on the summary of the second embodiment of the present invention is described in detail. In the present embodiment, the different part from the above-described first embodiment is mainly described, and the explanation of the same part is omitted.

<Sequential-Bending Forming Die>

Figure 18:
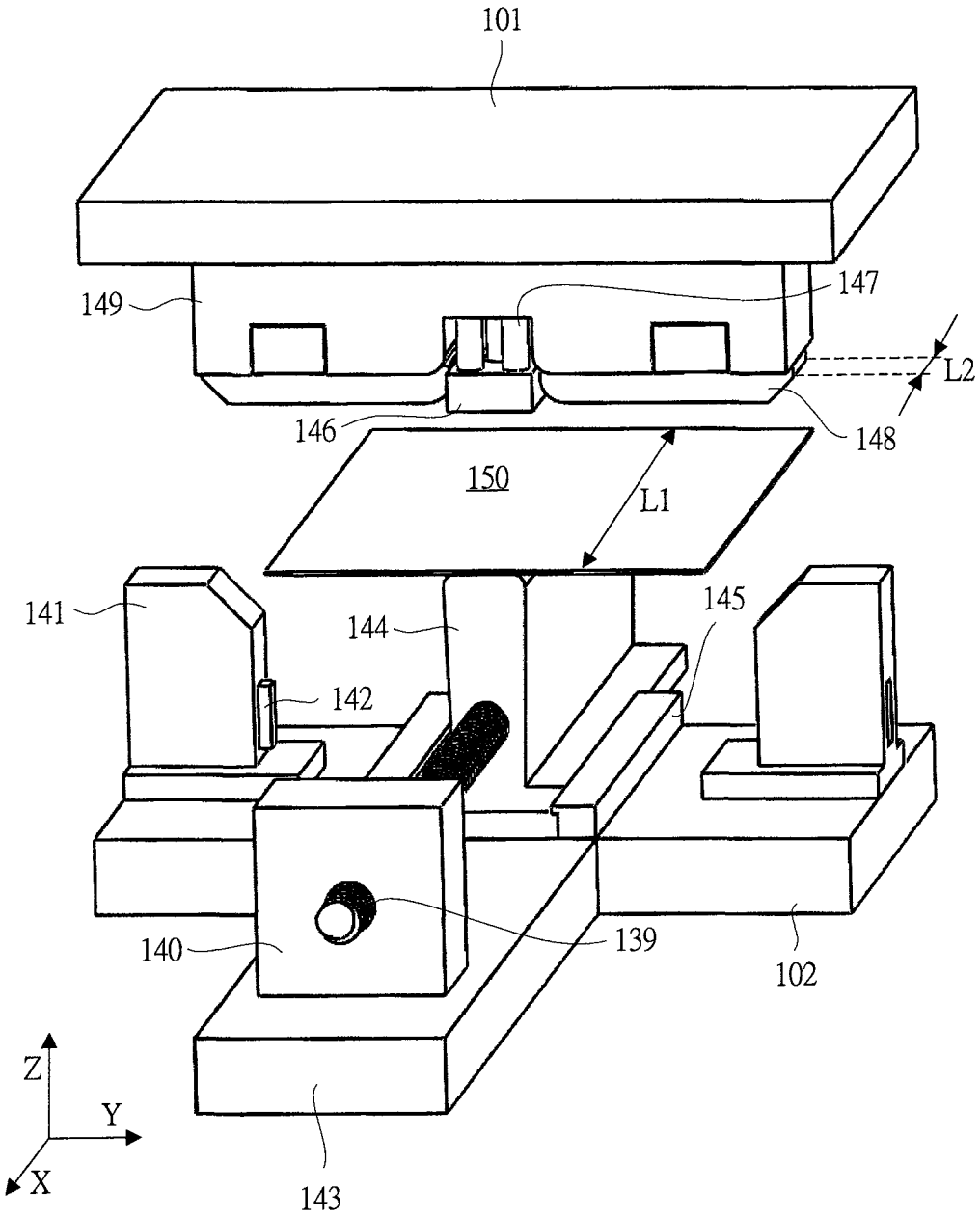
FIG. 18 is a view illustrating an example die for sequential-bending forming used for the forming by a servo press according to a second embodiment of the present invention.

In a servo press according to the second embodiment of the present invention, a forming method for sequential bending is described first with reference to FIG. 18. FIG. 18 is a view illustrating an example die for the sequential-bending forming used in forming by the servo press. FIG. 18 illustrates an example die used in bending a metal sheet into a U shape by the sequential forming. The method is accordingly described with a coordinate system illustrated in a lower left part of FIG. 18.

In FIG. 18, the lower die set plate 102 is fixed to the bolster 3 (not illustrated here but in FIG. 1) of the servo press. A movable die 144 is equipped on the lower die set plate 102, and the movable die 144 is fixed for displacement in a Y direction and a Z direction by a movable die guide member 145 fixed to the lower die set plate 102 and is movable in an X direction.

An actuator fixing member 143 is connected to the lower die set plate 102, and an actuator 140 is fixed thereon. A motor is embedded in the actuator 140, so that the movable die 144 can be moved in the X direction via a trapezoidal thread 139. An electromagnet is embedded in the movable die 144, so that a sequential bending workpiece 150 can be fixed. The actuator 140 may be an air cylinder, a hydraulic cylinder, or a hydraulic servo cylinder.

The upper die set plate 101 is fixed to the slide 4 (not illustrated here but in FIG. 1) of the servo press, and vertically moves in the Z direction. Moreover, a die guide member 149 is fixed to the upper die set plate 101, and a die 148 is attached to the die guide member 149. The die 148 is fixed for movement in the Z direction and the X direction by the die guide member 149, and is movable within an illustrated position in the Y direction.

A fixing plate 146 with the intermediation of a spring 147 is provided in the die 148 at a corresponding portion to the movable die 144, and the sequential bending workpiece 150 fixed to the movable die 144 is held by the fixing plate 146 in the sequential forming.

A cam 141 is fixed to the lower die set plate 102 so as to sandwich the movable die 144 in the Y direction. A displacement sensor 142 for measuring the springback magnitude of the sequential bending workpiece 150 is attached to the cam 141.

When the slide 4 is descended and the die 148 attached to the upper die set plate 101 is contacted with the cam 141 attached to the lower die set plate 102, the die 148 is moved inside in the Y direction. An X-direction width "L1" of the sequential bending workpiece 150 is longer than an X-direction width "L2" of the die 148. In the present forming method, the forming of the sequential bending workpiece 150 is repeated by ascending and descending the slide 4 in each feeding of the movable die 144 by a length "L3" which is about equal to L2, with using the motor embedded in the actuator 140. It is desirable to set the feeding length L3 to be equivalent to or shorter than L2.

<Sequential-Bending Forming>

Next, a forming method for the sequential bending workpiece 150 with high precision by using the servo press according to the present embodiment is described with reference to FIGS. 19 to 26.

Figure 19:
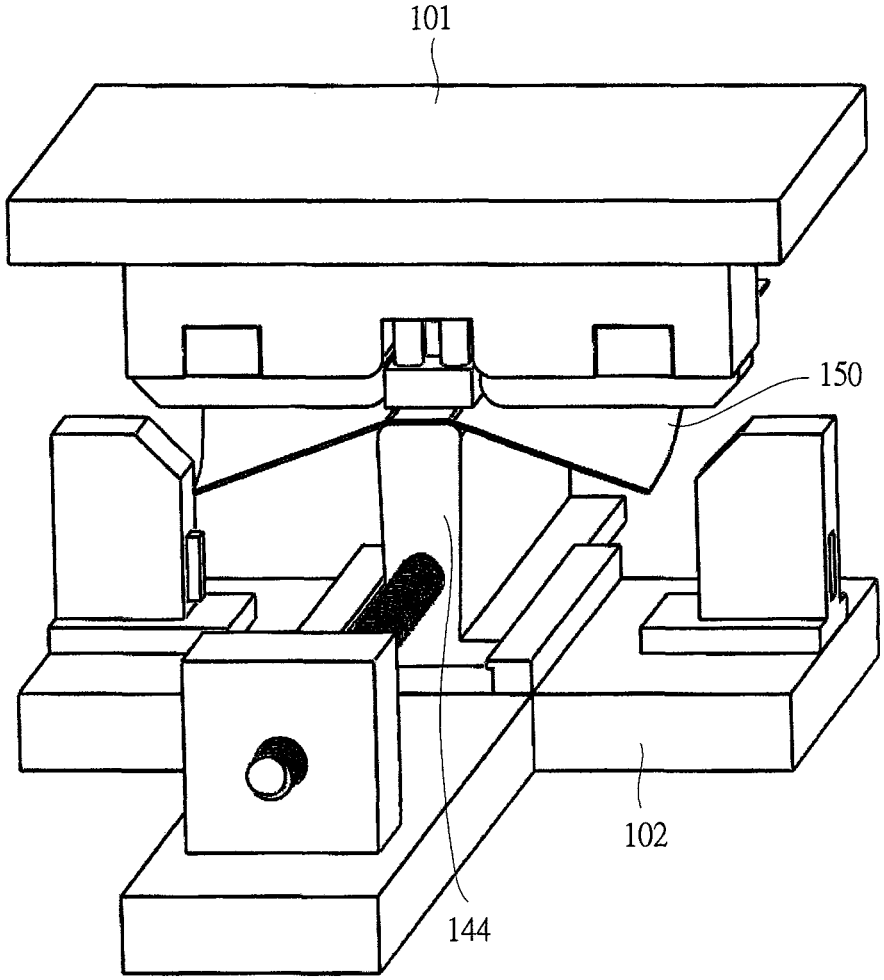
FIG. 19 is a view illustrating a first stroke of one feeding for a sequential-bending forming depth in an example forming method showing the effects of the present invention in the servo press according to the second embodiment of the present invention.
Figure 20:
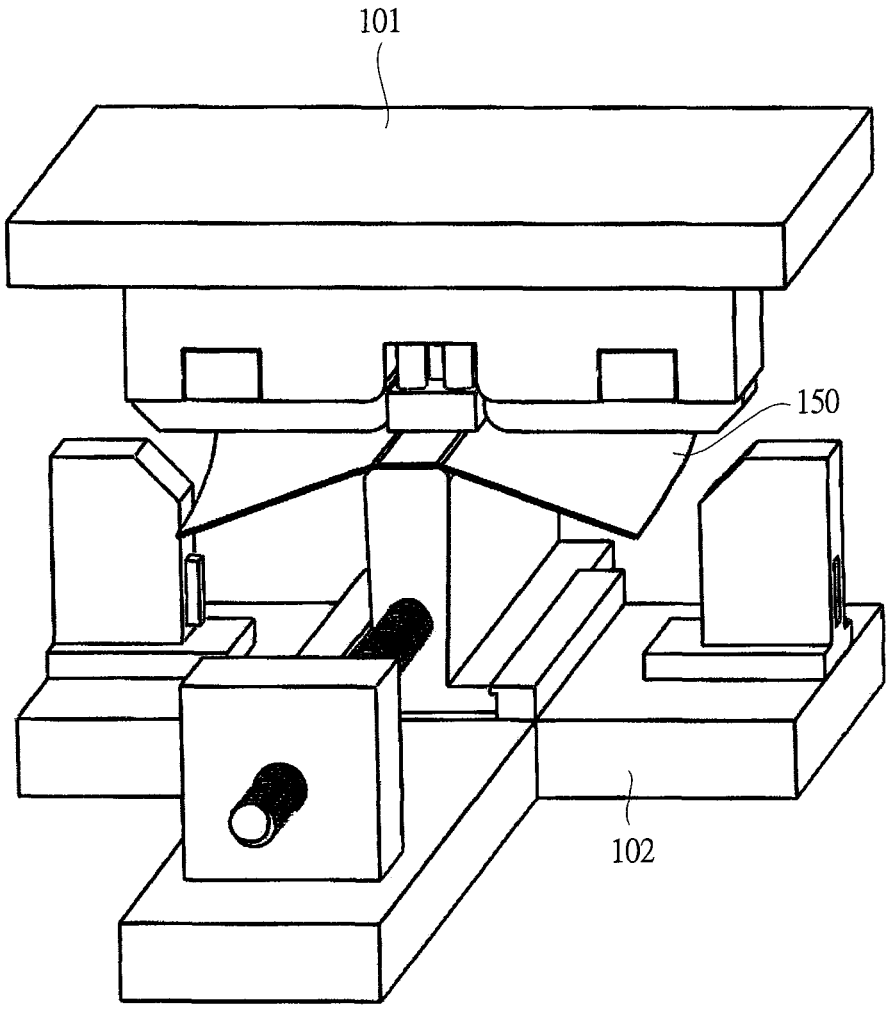
FIG. 20 is a view illustrating a second stroke of the one feeding for the sequential-bending forming depth in the example forming method showing the effects of the present invention in the servo press according to the second embodiment of the present invention.

FIG. 19 is a view, in a first stroke of one feeding for a sequential-bending forming depth, in which the slide 4 is descended to a forming depth "Z1" to form an X-direction end portion of the sequential bending workpiece 150. Then, while the slide 4 is ascended, the movable die 144 is moved by L3 in the X direction. Subsequently, the slide 4 is descended to the forming depth Z1 to form the sequential bending workpiece 150 again as illustrated in FIG. 20 (a second stroke of one feeding for the sequential-bending forming depth).

Figure 21:
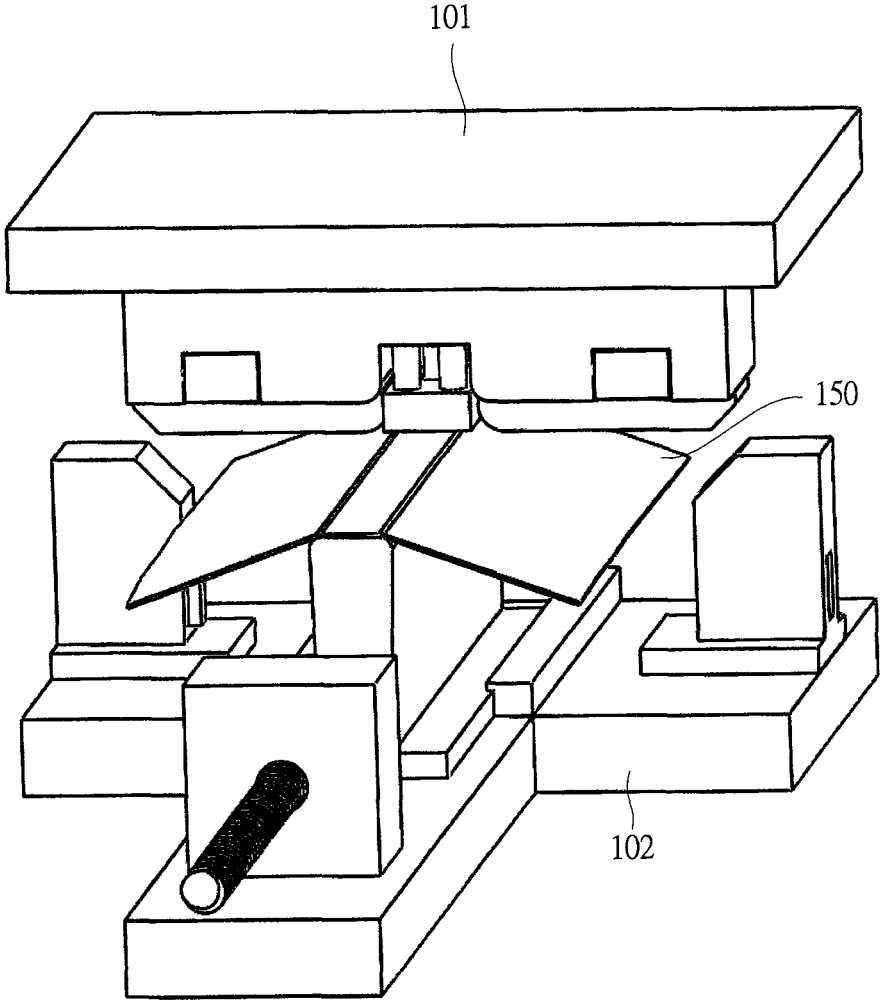
FIG. 21 is a view illustrating a third stroke of the one feeding for the sequential-bending forming depth in the example forming method showing the effects of the present invention in the servo press according to the second embodiment of the present invention.

By repeating this process, the end of the sequential bending workpiece 150 is formed as illustrated in FIG. 21 (a third stroke of one feeding for the sequential-bending forming depth). By such a sequential forming, even a large workpiece having a large sheet thickness can be formed with using a press having small performance. A reason why the workpiece is not formed into the U shape by only one process in this forming method is that, if strain in a plane of the workpiece is caused to a plastic deformation region, it is difficult to correct the shape at the end stage.

Note that the moving direction of the die may be reverse. However, in that case, there is provided a die structure in which buckling of the trapezoidal thread 139 is taken into consideration since the reaction force of the X direction caused in the forming acts in a compression direction.

Figure 22:
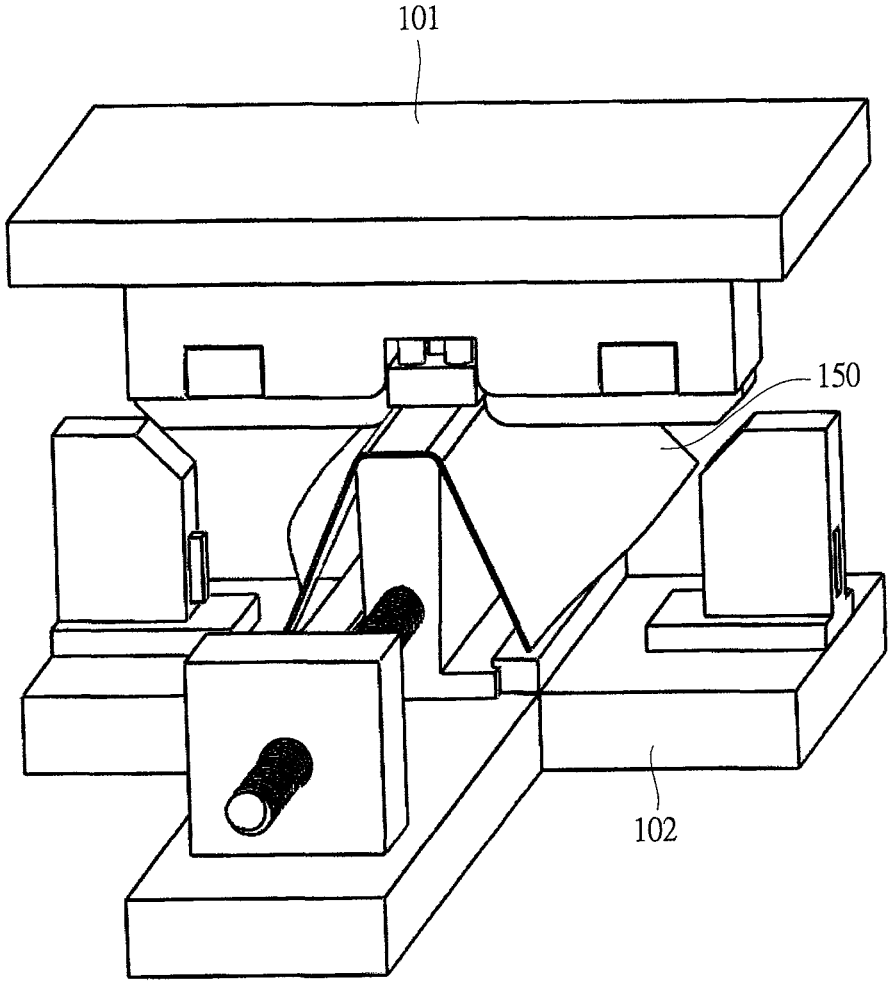
FIG. 22 is a view illustrating a second stroke for a sequential-bending forming depth in the example forming method showing the effects of the present invention in the servo press according to the second embodiment of the present invention.
Figure 23:
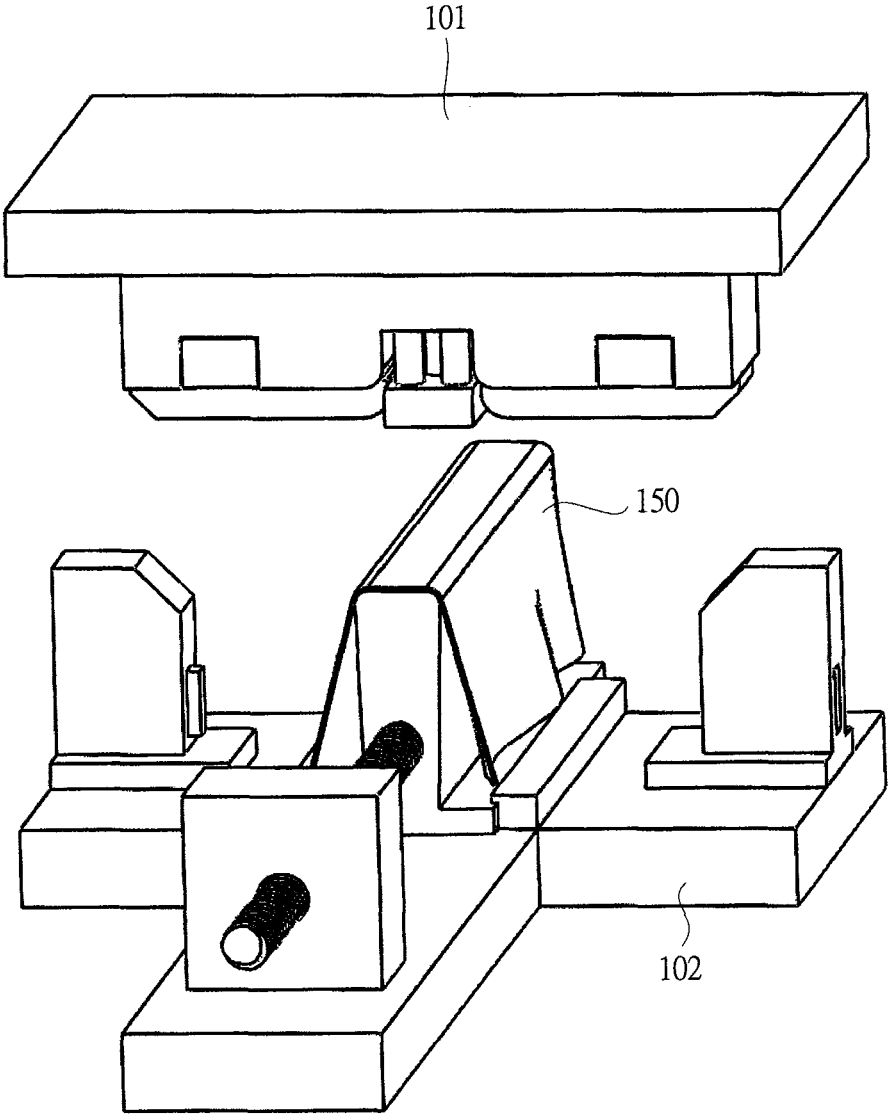
FIG. 23 is a view illustrating a measuring process for a sequential bending cross-sectional surface in the example forming method showing the effects of the present invention in the servo press according to the second embodiment of the present invention.

Then, the die is once returned to the position illustrated in FIG. 18, and the forming depth is changed to "Z2" (Z2 is lower than Z1) at this time, and then, the same forming as illustrated in FIG. 22 (a second stroke for the sequential-bending forming depth) is carried out again. By repeating the forming several times as changing the forming depth, the workpiece can be formed to be close to the U shape as illustrated in FIG. 23 (sequential bending section measuring process). In a large workpiece having a length of several meters, its springback magnitude is varied since the sheet thickness and material property thereof are not uniform. Therefore, as emphatically illustrated in FIG. 23, variabilities in the bending angle are caused in the length direction. In this manner, the uniformity of the bending angle in one workpiece is generally called longitudinal precision.

In order to improve the longitudinal precision, it is desirable to change the forming condition in each forming portion in last forming in accordance with the springback magnitude.

Therefore, in such a sequential forming, it is desirable to carry out the sequential feedback control forming which repeats a sequence that a series of processes of the measuring process 92, the modified slide motion data calculation process 93, and the adjust forming process 94, which are illustrated in the flow chart of FIG. 6 in the above-described first embodiment, are carried out, and the movable die 144 is moved in the X-axis direction by L3, and then, the series of processes of the measuring process 92, the modified slide motion data calculation process 93, and the adjust forming process 94 are carried out again.

Figure 24:
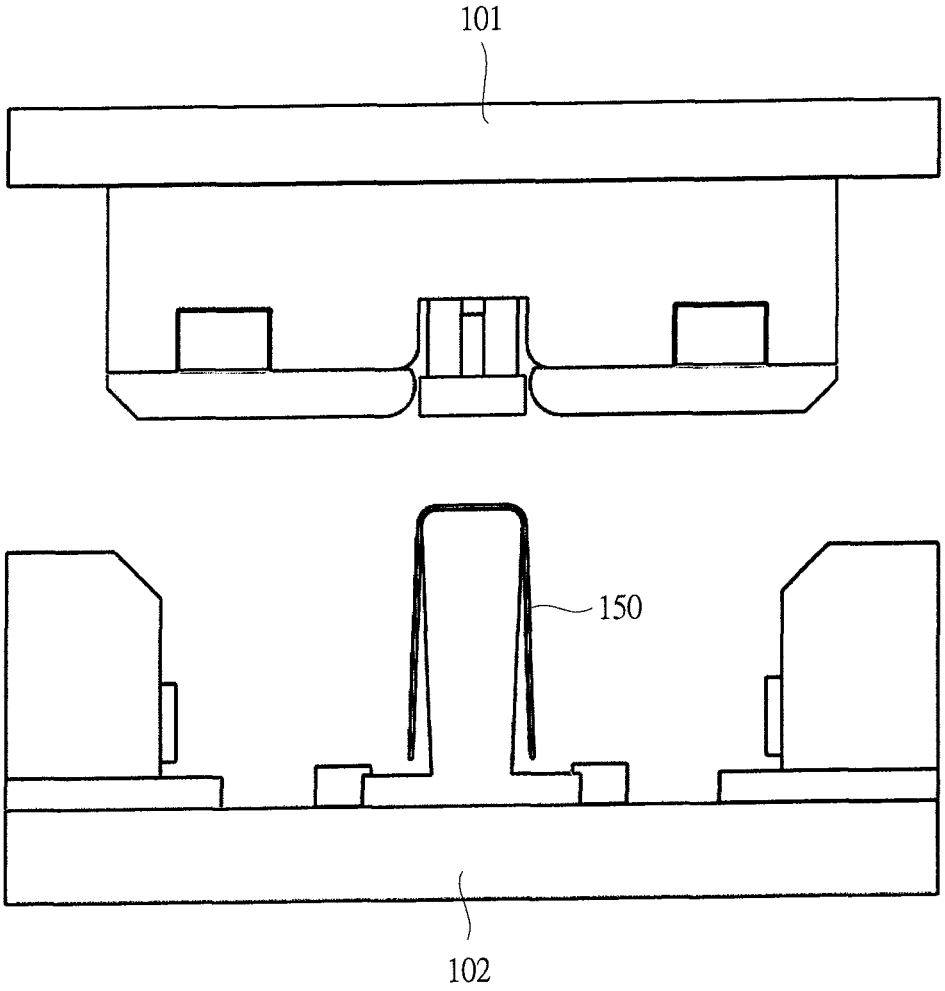
FIG. 24 is another view illustrating the measuring process for the sequential bending cross-sectional surface in the example forming method showing the effects of the present invention in the servo press according to the second embodiment of the present invention.
Figure 25:
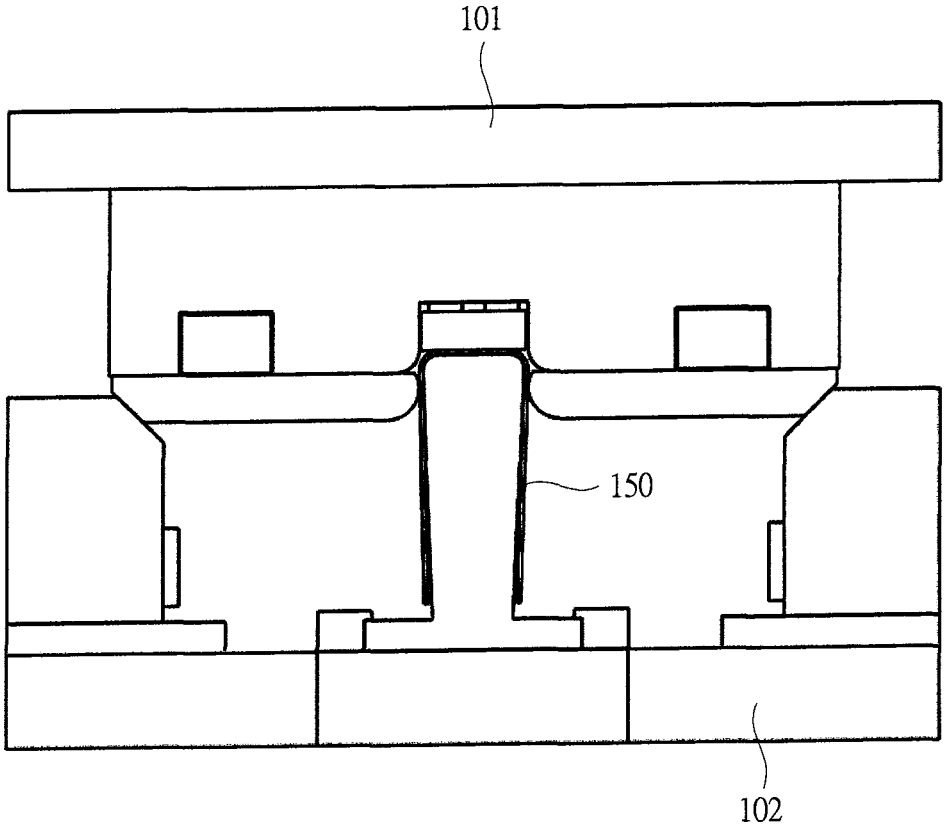
FIG. 25 is a view illustrating an adjust forming process for the sequential bending cross-sectional surface in the example forming method showing the effects of the present invention in the servo press according to the second embodiment of the present invention.
Figure 26:
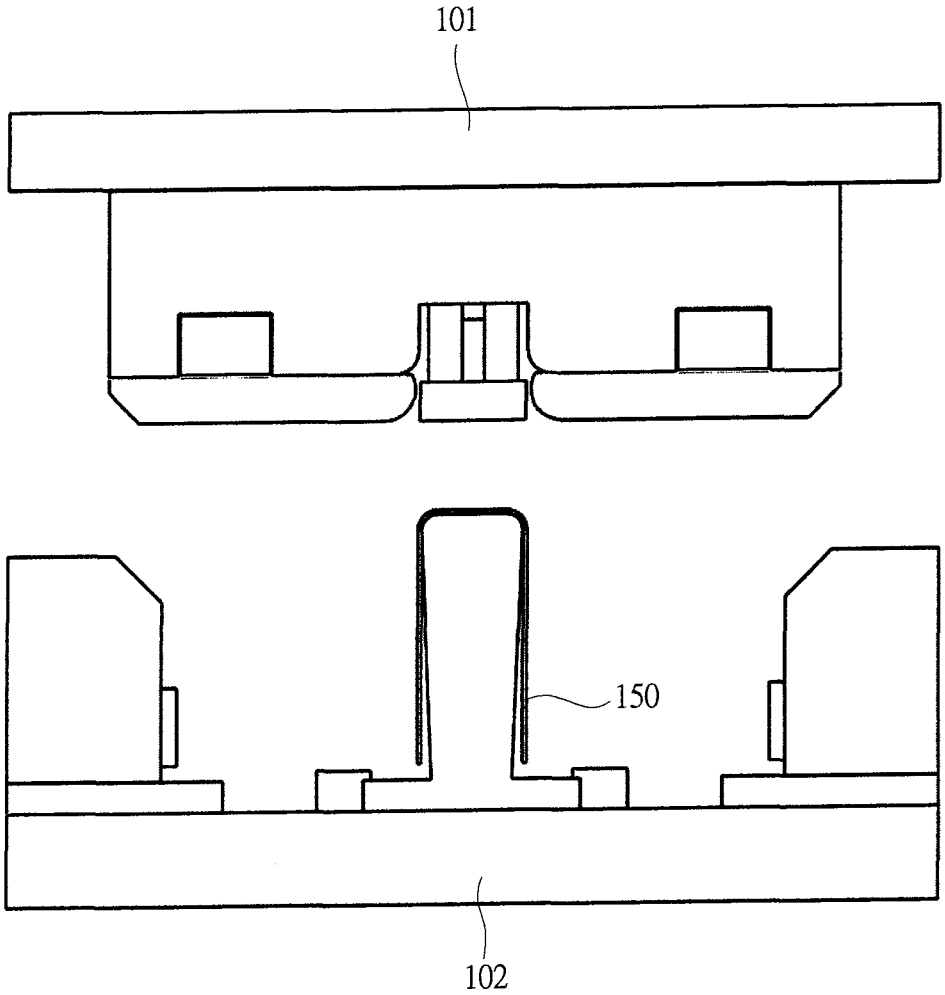
FIG. 26 is a view illustrating a completing process for the sequential bending cross-sectional surface in the example forming method showing the effects of the present invention in the servo press according to the second embodiment of the present invention.

A formed cross-section surface at this time is illustrated in FIGS. 24 to 26. FIG. 24 (sequential-bending section measuring process) corresponds to the measuring process 92, FIG. 25 (sequential-bending section adjust forming process) corresponds to the adjust forming process 94, and as a result, the 90-degree-bent cross-section surface from which the influence of the springback is eliminated can be obtained as illustrated in FIG. 26 (sequential-bending section completing process).

In a conventional controlling device for a servo press, it is supposed that the forming is carried out by the same slide motion data 29 during automatic operation of the servo press. However, in the sequential forming described in the present embodiment, a plurality of different slide motions are used for the forming one workpiece. For the viewpoint of convenience, it is desirable to provide the sequential forming program data for integrating the plurality of slide motions. Moreover, for convenience as the controlling device, it is better to include a signal for operating the actuator 140, which moves the movable die 144, in the same sequential forming program data.

<Forming Method of Sequential-Bending Forming>

Figure 27:
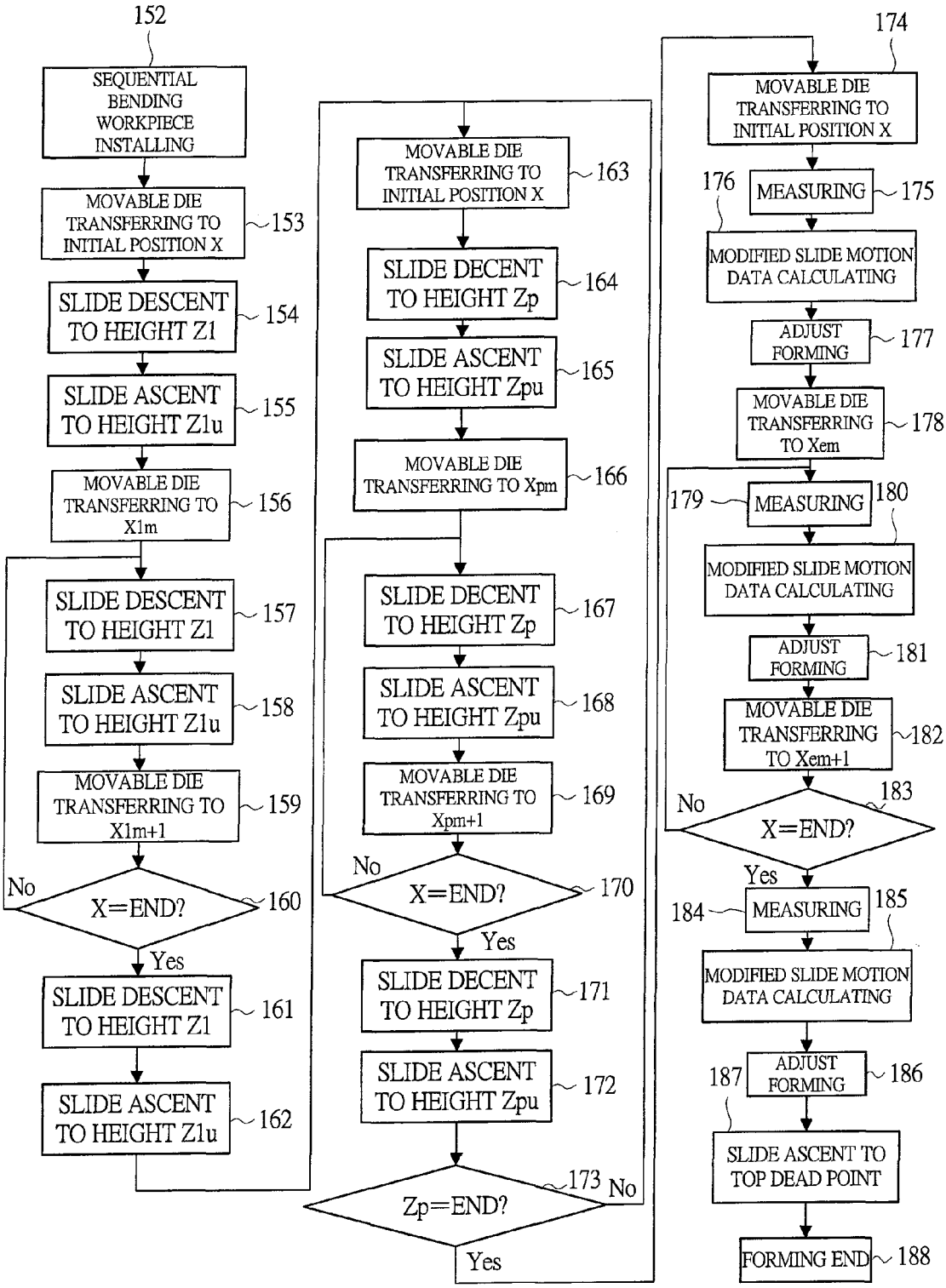
FIG. 27 is a flow chart illustrating an operation of the sequential-bending forming in the example forming method showing the effects of the present invention in the servo press according to the second embodiment of the present invention.

Next, the forming method for the sequential bending workpiece 150 with using the servo press according to the present embodiment is described with reference to FIG. 27. FIG. 27 is a flow chart illustrating the operation of the sequential-bending forming.

First, in a sequential bending workpiece installing process 152, the sequential bending workpiece 150 is installed on the movable die 144. Subsequently, in a "movable die transferred to initial position on X coordinate" process A153, a drive signal is sent from a die actuator drive command sending portion 193 described later with reference to FIG. 28, to a die actuator 192 (corresponding to the actuator 140 in FIG. 18), so that the movable die 144 is moved to the X initial position. FIG. 18 described above corresponds to this process. Subsequently, in a "slide descent to height Z1" process A154, the slide 4 is descended to the height Z1 so as to descend the die 148, so that the sequential bending workpiece 150 is formed. FIG. 19 described above corresponds to this process. Also, FIGS. 19 to 21 described above correspond to the process at the slide height Z1. Subsequently, in a "slide ascent to height Z1*u* (Z1*u*>Z1)" process A155, the slide 4 is ascended to the height Z1*u* so as to ascend the die 148 to be released.

Subsequently, in a "movable die transferred to X1*m*" process 156, a drive signal is sent from the die actuator drive command sending portion 193 to the die actuator 192, so that the movable die 144 is moved to the X1*m* position. Subsequently, in a "slide descent to height Z1" process B157, the slide 4 is descended to the height Z1 so as to descend the die 148, so that the sequential bending workpiece 150 is formed again. FIG. 20 described above corresponds to this process. Subsequently, in a "slide ascent to height Z1*u*" process B158, the slide 4 is ascended to the height Z1*u* so as to ascend the die 148 to be released. Subsequently, in a "movable die transferred to X1*m*+1" process 159, the movable die 144 is moved to the X1*m*+1 position.

Subsequently, in an "X position judgment" process A160, it is judged whether the X position of the movable die 144 reaches an end position or not. If the X position has not reached the end position yet (160-No), the process is returned to the "slide descent to height Z1" process B157. If the X position of the movable die 144 has reached the end position (160-Yes), in the "slide descent to height Z1" process C161, the slide 4 is descended to the height Z1 so as to descend the die 148, so that the sequential bending workpiece 150 is formed. Subsequently, in a "slide ascent to height Z1*u*" process C162, the slide 4 is ascended to the height Z1*u* so as to ascend the die 148 to be released.

Subsequently, in a "movable die transferred to initial position on X coordinate" process B163, the movable die 144 is returned to the X initial position. FIG. 21 described above corresponds to this process. Subsequently, in a "slide descent to height Zp (p=2, Z2<Z1)" process A164, the slide 4 is descended to the height Zp so as to descend the die 148, so that the sequential bending workpiece 150 is formed. FIG. 22 described above corresponds to this process. Also, FIG. 22 described above corresponds to the process at the slide height Z2. Subsequently, in a "slide ascent to height Zpu (Zpu>Zp)" process A165, the slide 4 is ascended to the height Zpu so as to ascend the die 148 to be released.

Subsequently, in a "movable die transferred to Xpm" process 166, the movable die 144 is moved to the Xpm position. Subsequently, in a "slide descent to height Zp" process B167, the slide 4 is descended to the height Zp so as to descend the die 148, so that the sequential bending workpiece 150 is formed. Subsequently, in a "slide ascent to height Zpu" process B168, the slide 4 is ascended to the height Zpu so as to ascend the die 148 to be released. Subsequently, in a "movable die transferred to Xpm+1" process 169, the movable die 144 is moved to the Xpm+1 position.

Subsequently, in an "X position judgment" process B170, it is judged whether the movable die 144 reaches an end position or not. If the movable die 144 has not reached the end position yet (170-No), the process is returned to the "slide descent to height Zp" process B167. If the movable die 144 has reached the end position (170-Yes), in the "slide descent to height Zp" process C171, the slide 4 is descended to the height Zp so as to descend the die 148, so that the sequential bending workpiece 150 is formed. Subsequently, in a "slide ascent to height Zpu" process C172, the slide 4 is ascended to the height Zpu so as to ascend the die 148 to be released. FIG. 23 described above corresponds to this process.

Next, in a forming depth judging process 173, it is judged whether a value of Zp reaches a predetermined forming depth or not. If the value has not reached yet (173-No), the process is returned to the "movable die transferred to initial position on X coordinate" process B163 (Zp=Z3, Z4, Z3<Z2, Z4<Z3, . . . ). If the value has reached (173-Yes), the process proceeds to a "movable die transferred to initial position on X coordinate" process C174, and the movable die 144 is returned to the X initial position.

Subsequently, in a measuring process A175, the springback magnitude of the sequential bending workpiece 150 is measured with using the displacement sensor 142 in FIG. 18. FIG. 24 described above corresponds to this process. Further, in a modified slide motion data calculation process A176, the height of the slide 4 in the forming in an adjust forming process A177 to be carried out next is calculated. Then, in the adjust forming process A177, the adjust forming is carried out, and then, the die 148 is returned to the ascend point. FIG. 25 described above corresponds to this process.

Subsequently, in a "movable die transferred to Xem" process 178, the movable die 144 is moved to an Xem position. Subsequently, in a measuring process B179, the springback magnitude of the sequential bending workpiece 150 is measured. FIG. 24 described above corresponds to this process. Further, in a modified slide motion data calculation process B180, the forming depth of the slide 4 in an adjust forming process B181 to be carried out next is calculated. Then, in the adjust forming process B181, the sequential bending workpiece 150 is formed, and then, the die 148 is returned to the ascend point. FIG. 25 described above corresponds to this process.

Subsequently, in a "movable die transferred to Xem+1" process 182, the movable die 144 is moved to an Xem+1 position. Subsequently, in an X position judging process C183, it is judged whether the movable die 144 reaches the end position or not. If the movable die 144 has not reached yet (183-No), the process is returned to the measuring process B179. If the movable die 144 has reached the end position (183-Yes), the process proceeds to a measuring process C184.

Subsequently, in the measuring process C184, the springback magnitude of the sequential bending workpiece 150 is measured. FIG. 24 described above corresponds to this process. Further, in a modified slide motion data calculation process C185, the forming depth of the slide 4 in an adjust forming process C186 to be carried out next is calculated. Then, in the adjust forming process C186, the sequential bending workpiece 150 is formed. FIG. 25 described above corresponds to this process.

Subsequently, in a "slide ascent to top dead point" process 187, the slide 4 is returned to the top dead point to return the die 148 to the top dead point. FIG. 26 described above corresponds to this process. Then, in a forming end process D188, the forming is finished.

<Details of Controlling Device for Sequential Forming>

Figure 28:
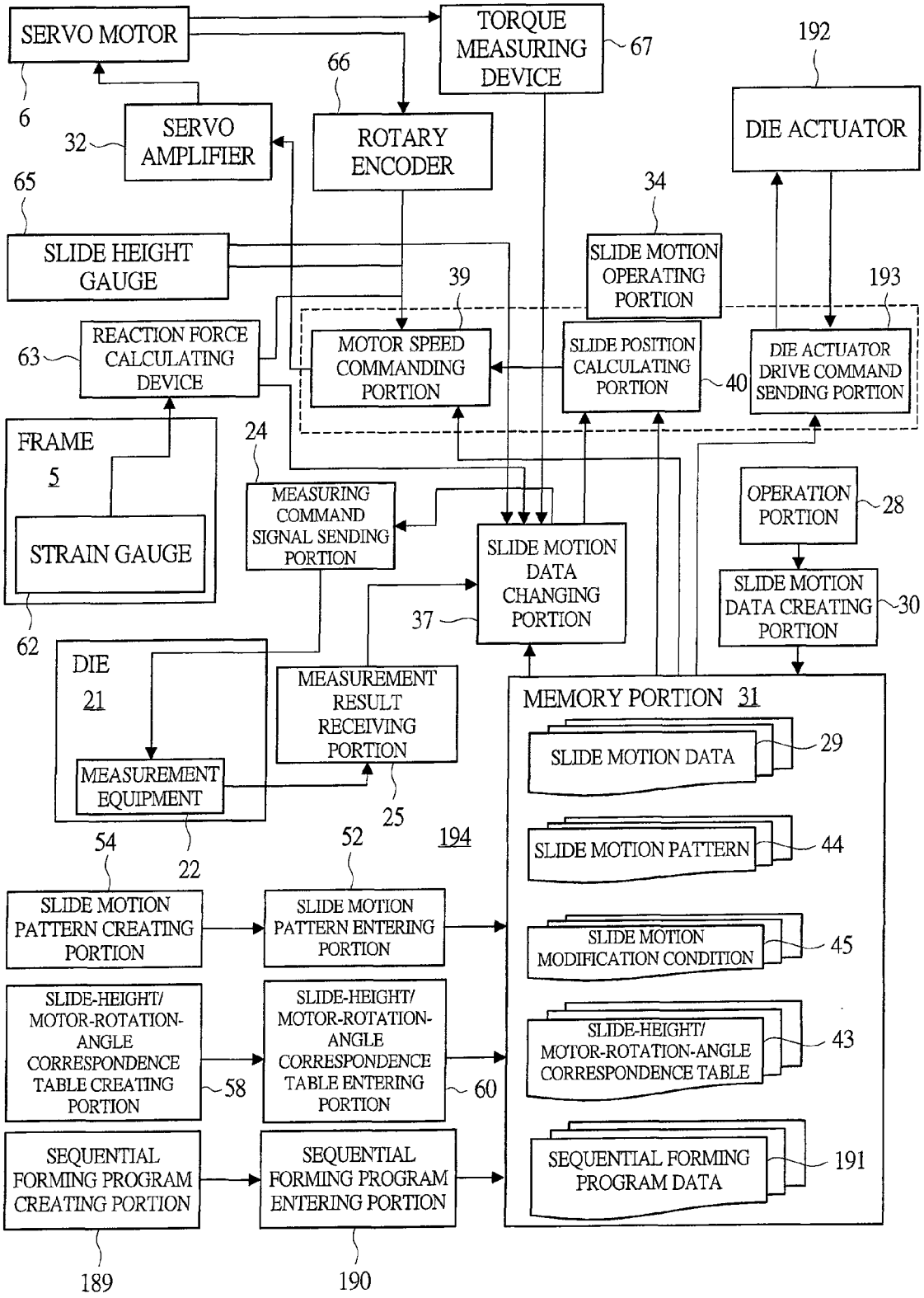
FIG. 28 is a diagram illustrating an example controlling device for the sequential forming in the servo press according to the second embodiment of the present invention.

Next, with reference to FIG. 28, details of the controlling device for the sequential forming in the servo press according to the present embodiment are described. FIG. 28 is a view illustrating an example controlling device for the sequential forming in the servo press.

A controlling device 194 for the sequential forming includes, in addition to the structure illustrated in FIG. 2 in the above-described first embodiment: a sequential forming program creating portion 189; and a sequential forming program entering portion 190, and a program created by the sequential forming program creating portion 189 is stored in the memory portion 31 as a sequential forming program data 191 by the sequential forming program entering portion 190.

Also, the controlling device 194 for the sequential forming further includes the die actuator drive command sending portion 193. The die actuator drive command sending portion 193 sends an operation command to the die actuator 192 (corresponding to the actuator 140 in FIG. 18) in synchronization with the operation of the servo press, so that the die 21 (whose details are illustrated in FIG. 18) is driven. Moreover, the die actuator drive command sending portion 193 receives a signal of operating completion from the die actuator 192, and sends a signal of handling completion to the slide motion operating portion 34 so that a next process can be started. The die actuator drive command sending portion 193 controls the die actuator 192 based on the sequential forming program data 191. In the sequential forming, the plurality of different slide motions are used for forming one workpiece, and it is desirable to provide the sequential forming program data 191 for coordinating the plurality of slide motions from the viewpoint of convenience. Moreover, for convenience as the controlling device 194, it is better to include the signal for operating the actuator 140, which moves the die 21, in the same sequential forming program data 191.

In the controlling device 194 for the sequential forming, all the data is stored in one memory portion 31. However, the sequential forming program data 191 may be stored in another memory portion. Similarly, the sequential forming program creating portion 189, the sequential forming program entering portion 190, and the die actuator drive command sending portion 193 may be a controlling device for the sequential forming which is separated from the controlling device for the servo press illustrated in FIG. 2. When the sequential-bending forming is carried out by an existing servo press, such a configuration is desirable since the sequential-bending forming can be carried out at lower cost.

<Sequential Forming Program Creating Portion of Controlling Device for Sequential Forming>

Figure 30:
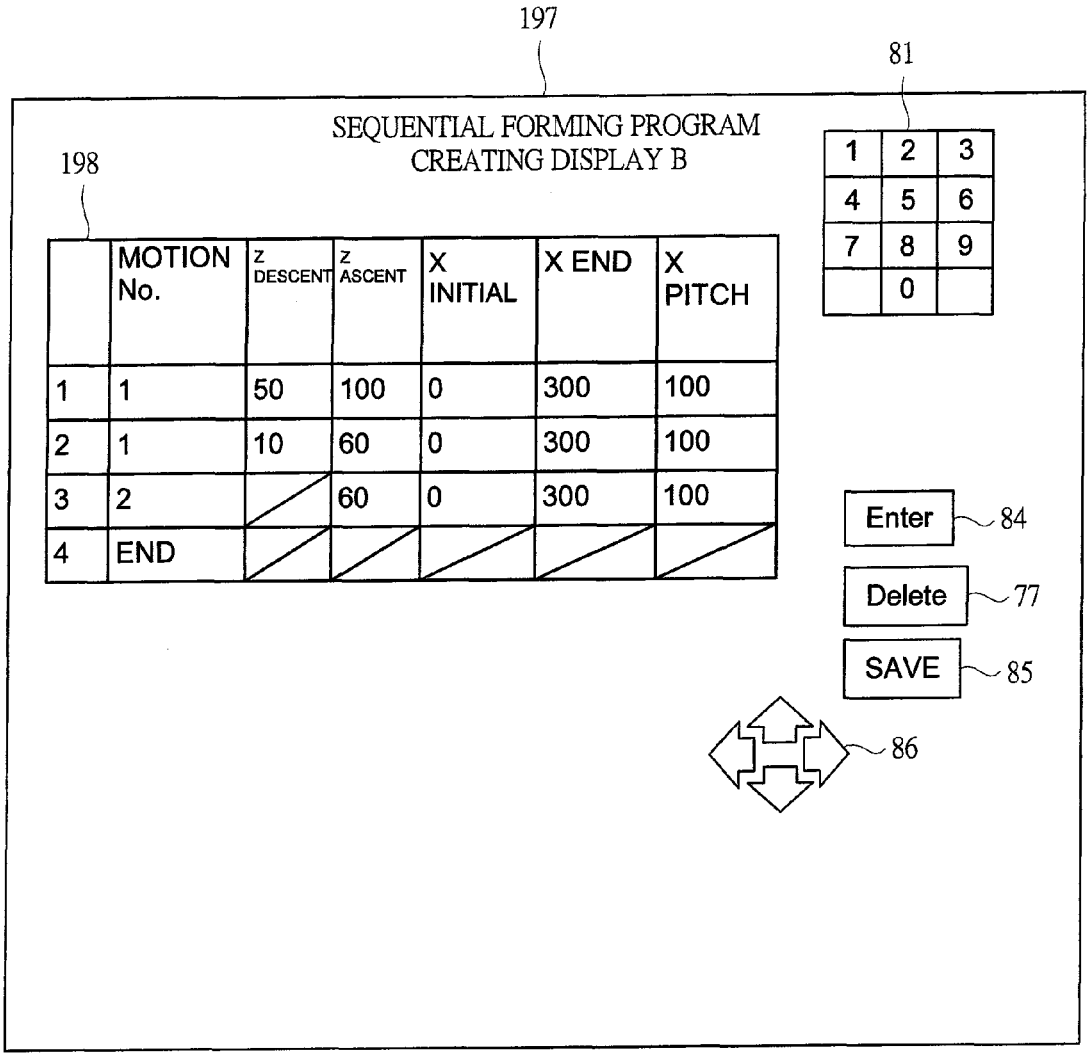
FIG. 30 is a view illustrating a sequential forming program creating display "B" in the example forming method showing the effects of the present invention in the servo press according to the second embodiment of the present invention.

Next, the sequential forming program creating portion 189 of the controlling device 194 for the sequential forming according to the present embodiment is described with reference to FIGS. 29 to 31. FIG. 29 is a view illustrating a sequential forming program creating display A, FIG. 30 is a view illustrating a sequential forming program creating display B, and FIG. 31 is a view illustrating a sequential forming program creating display C.

The sequential forming program creating display A for the sequential forming program creating portion A195 illustrated in FIG. 29 is composed of: a sequential forming program table A196; a numerical keypad 81; an enter key 84; a delete key 77; a save key 85; and a cursor key 86.

In the sequential forming program table A196, ordinal numbers (1 to 13) and values corresponding to items (slide motion No., X, Z descent, and Z ascent) are illustrated in a matrix form.

In a first column (slide motion No.), a program number of the applied slide motion program is inputted. The slide motion number is inputted by the numerical keypad 81, and is determined by the enter key 84. For changing content, the content may be deleted by the delete key 77, and another content may be inputted again. The slide motion number indicates a slide motion pattern number created by the slide motion pattern creating portion 54 illustrated in FIG. 3 according to the above-described first embodiment.

In the sequential forming program table A196, slide motions created by using the reciprocal pattern are invoked from a first row to an eighth row. Also, in the slide motions, the reciprocating height is described as a variable, and a value of a third column (Z descent) in the sequential forming program table A196 is read.

In a second column (X) from the first to eighth rows in the sequential forming program table A196, the moving distances of the movable die 144 in the "movable die transferred to X1*m*" process 156, the "movable die transferred to X1*m*+1" process 159, the "movable die transferred to Xpm" process 166, the "movable die transferred to Xpm+1" process 169, the "movable die transferred to Xem" process 178, and the "movable die transferred to Xem+1" process 182 illustrated in the flow chart of FIG. 27 are described. The sequential forming program creating display A195 has a procedure for describing such a moving distance of the movable die 144.

In a third column (Z descent) from the first to eighth rows in the sequential forming program table A196, the slide heights in the "slide descent to Z1" process A154, the "slide descent to Z1" process B157, the "slide descent to Z1" process C161, the "slide descent to Zp" process A164, the "slide descent to Zp" process B167, and the "slide descent to Zp" process C171 are described. The sequential forming program creating portion A195 has a procedure for describing such a slide height. This value may be described as a distance from a mechanical lower limit value of the slide height or a mechanical upper limit value of the slide height. Also, this value may be described as an angle of rotation of the crank axis.

In a fourth column (Z ascent) from the first to eighth rows in the sequential forming program table A196, the slide ascent positions in the "slide ascent to Z1*u*" process A155, the "slide ascent to Z1*u*" process B158, the "slide ascent to Z1*u*" process C162, the "slide ascent to Zpu" process A165, the "slide ascent to Zpu" process B168, and the "slide ascent to Zpu" process C172, which are illustrated in the flow chart in FIG. 27, are described. The sequential forming program creating portion A195 has a procedure for describing such a slide ascent position. This value may be described as a distance from the mechanical lower limit value of the slide height or the mechanical upper limit value of the slide height. Also, this value may be described as the angle of rotation of the crank axis. Alternatively, this value may be described as a relative height based on an arbitral height.

From ninth to twelfth rows in the sequential forming program table A196, the slide motions with using the feedback control pattern 50 described in the first embodiment are invoked. In this case, it is not required to describe the slide lower limit height of the third column since the slide lower limit height is calculated in the slide motions. The slide upper limit height of the fourth column is described in the slide motions. Also, the slide upper limit height may be described as a variable in the slide motions, and may be described in the fourth column of the sequential forming program table A196.

In the sequential forming program table A196, the first to fourth rows correspond to the "movable die transferred to initial position on X coordinate" process A153 to the "slide ascent to height Z1*u*" process C162 in FIG. 27. The fifth to eighth rows correspond to the "movable die transferred to initial position on X coordinate" process B163 to the "slide ascent to height Zpu" process C172. And, the ninth to thirteenth rows correspond to the "movable die transferred to initial position on X coordinate" process C174 to the forming end process 188.

FIG. 30 illustrates an example of the sequential forming program creating portion B197 for further easily inputting each condition in FIG. 29. The sequential forming program creating display B for the sequential forming program creating portion B197 is composed of: a sequential forming program table B198; a numerical keypad 81; an enter key 84; a delete key 77; a save key 85; and a cursor key 86.

In the sequential forming program table B198, ordinal numbers (1 to 4) and values corresponding to items (slide motion No., Z descent, Z ascent, X initial, X last, and X pitch) are illustrated in a matrix form.

In a first column (slide motion No.), a symbol representing the invoked slide motion such as a number is described. A character string representing a slide motion name may be described instead of the number. In a first row and a second row, a reciprocal slide motion is invoked.

In the reciprocal sliding motion, the lower limit height and the upper limit height of the slide are described as variables, and values of a second column (Z descent) and a third column (Z ascent) of the sequential forming program table B198 are substituted into the variables for the operation. Moreover, an X-direction initial position is described in a fourth column (X initial), an X-direction last position is described in a fifth column (X last), and an X-direction feeding pitch of the movable die 144 is described in a sixth column (X pitch). In the present embodiment, the feeding for a length of 300 mm is carried out by a pitch of 100 mm, and therefore, the description of this one row corresponds to the description of four rows in the sequential forming program table A196 illustrated in FIG. 29.

In the sequential forming program table B198, the further forming can be carried out step by step by increasing the number of rows. In a third row, a slide motion created based on the feedback control pattern 50 is invoked. Also in this case, the third row of the sequential forming program table B198 can be expressed by one row instead of the ninth row to the twelfth row in the sequential forming program table A196 illustrated in FIG. 29. By using the sequential forming program creating portion B197, the sequential forming program can be more easily created.

FIG. 31 illustrates an example of a sequential forming program creating portion c199 capable of creating a sequential forming program having a higher degree of freedom, although its programming operation is conversely complicated. A sequential forming program creating display C of the sequential forming program creating portion C199 is composed of: a sequential forming program table C200; a numerical keypad 81; an enter key 84; a delete key 77; a save key 85; and a cursor keys 86.

In the sequential forming program table C200, ordinal numbers (1 to 10) and values corresponding to items (slide motion No., Z descent, Z ascent, X initial, X last, and X pitch) are illustrated in a matrix form.

In the sequential forming program creating portion C199, the lower limit value (Z descent) and the upper limit value (Z ascent) of the slide, the initial position (X initial) and the last position (X last) of the movable die 144 in the X direction, and the pitch (X pitch) thereof can be described for every forming of sequential forming. Therefore, the sequential forming program data 191 having higher degree of freedom can be created.

Note that there may be provided a sequential forming program creating portion formed by integrating the slide motion data creating portion 30 with the functions described in the sequential forming program creating portion A195, the sequential forming program creating portion B197, and the sequential forming program creating portion C199 of the present embodiment.

<Effects of the Present Embodiment>

According to the present embodiment described above, the same effects as the above-described first embodiment can be obtained, and further, more particularly, the controlling device 194 for the sequential forming includes: the slide motion data changing portion 37; the measurement result receiving portion 25; and the die actuator drive command sending portion 193, changes the slide motion data for forming the same workpiece as the sequential bending workpiece 150 at the scheduled measuring time in accordance with the measurement result sent from the displacement sensor 142 which is the measurement equipment attached to the die 21, and drives the actuator 140 so as to carry out the slide motion for the adjust forming a plurality of times for one workpiece in accordance with the slide motion data, so that the optimal forming for handling the variability in the sheet thickness and material property of the workpiece and for handling each workpiece can be achieved, and therefore, the precision and quality of the formed product made of the sequential bending workpiece 150 can be improved.

Also, since the sequential forming program data 191 can be newly added, usage of the data in another servo presses can be also facilitated, and further, a controlling device for various forming which have different sequential forming methods can be introduced at low cost.

[Third Embodiment of the Present Invention]

<Summary of Third Embodiment of the Present Invention>

A third embodiment of the present invention describes an example that the invention is applied to sequential-forging bending instead of the sequential-bending forming of the above-described second embodiment. In the third embodiment of the present invention, a controlling device for a servo press is a controlling device for the sequential forming, of controlling the servo press in accordance with a slide motion data, the servo press being composed of: a frame; a bed; a bolster; a slide; a servo motor; and a conversion mechanism of rotational force to linear force. The controlling device includes: a slide motion data changing portion; a measurement result receiving portion; and a die actuator drive command sending portion, and changes the slide motion data for the next slide motion or a subsequent slide motion for the forming in accordance with a measurement result sent from the die after forming the workpiece once or more.

Hereinafter, a third embodiment based on the summary of the third embodiment of the present invention is described in detail. In the present embodiment, the different part from the above-described second embodiment is mainly described, and the explanation of the same part is omitted.

<Sequential-Forging Bending>

Figure 32:
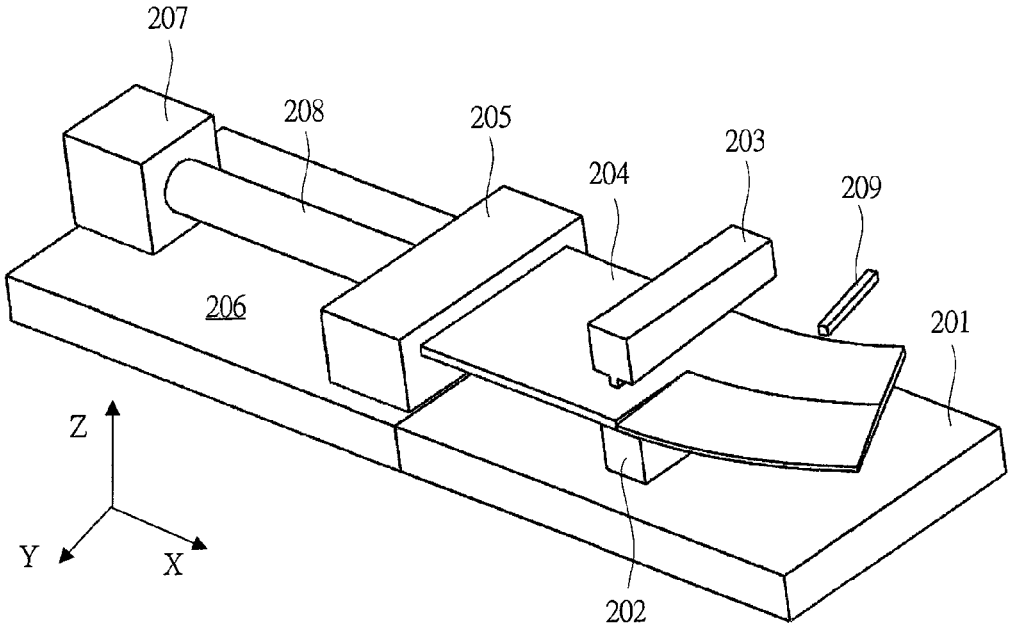
FIG. 32 is a view illustrating sequential-forging bending in an example forming method showing effects of the present invention in a servo press according to a third embodiment of the present invention.
Figure 33:
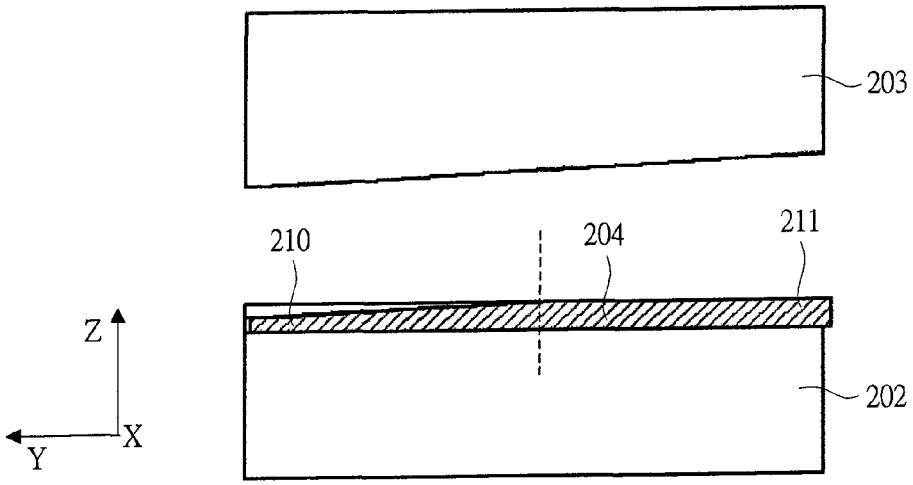
FIG. 33 is a view illustrating a cross-sectional surface of the sequential-forging bending in the example forming method showing the effects of the present invention in the servo press according to the third embodiment of the present invention.
Figure 34:
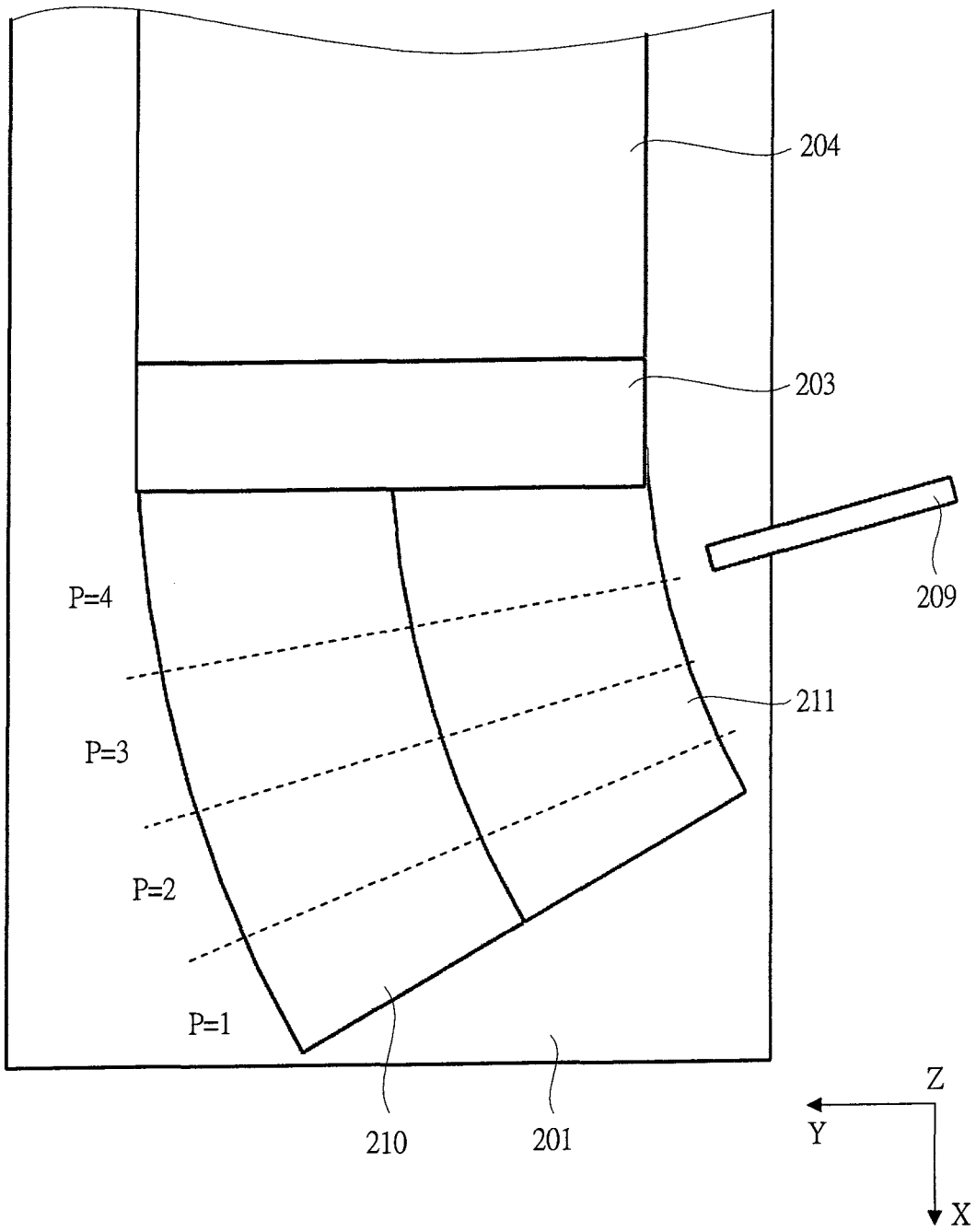
FIG. 34 is a view illustrating an upper surface of the sequential-forging bending in the example forming method showing the effects of the present invention in the servo press according to the third embodiment of the present invention.

In a servo press according to the third embodiment of the present invention, a target forming method for sequential-forging bending is described first with reference to FIGS. 32 to 34. FIG. 32 is a view illustrating the sequential-forging bending, FIG. 33 is a view illustrating a cross-sectional surface of the sequential-forging bending, and FIG. 34 is a view illustrating an upper surface of the sequential-forging bending.

As illustrated in FIG. 32, the die 21 for the sequential forging includes: a sequential forging lower die 202 fixed to a lower plate 201 fixed to a bolster 3 (not illustrated here but in FIG. 1) of the servo press; and a sequential forging upper die 203 attached to an upper plate (not illustrated) attached to a slide 4 (not illustrated here but in FIG. 1).

A sequential forging workpiece 204 is pushed by a pushing die 205 so as to move in the X direction, and the workpiece is forged with the sequential forging lower die 202 and the sequential forging upper die 203 by the slide 4 ascent and descent.

Also, a die actuator 207 is fixed to an actuator fixing plate 206 joined with a lower plate C201, and feeds a pushing rod 208 in accordance with a command sent from the die actuator drive command sending portion 193 so that the pushing die 205 is driven in the X direction.

A displacement sensor 209 measures a shape of the sequential forging workpiece 204 after the sequential forging.

FIG. 33 illustrates a view in a ZY cross-section surface of a portion of the sequential forging lower die 202 and the sequential forging upper die 203 in FIG. 32. The sequential forging workpiece 204 is formed with using the sequential forging lower die 202 and the sequential forging upper die 203. A slope shape is provided in the sequential forging upper die 203, a portion of the workpiece toward the Y direction becomes a forged portion 210 for the forging, and a portion of the workpiece toward the opposite direction becomes a non-forged portion 211 for the non-forging.

As a result, as illustrated in FIG. 34, in-plane bending in the XY plane is achieved by stretching the forged portion 210. The forged portion 210 is increased as descending the sequential forging upper die 203 lower in the Z direction, so that the in-plane bending is further increased, and its curvature radius is further reduced. The displacement sensor 209 is used for measuring the curvature radius in the in-plane bending. The curvature radius is varied depending on variability in a sheet thickness of the sequential forging workpiece 204 even when their forming conditions are the same. Therefore, also in such a forming method, by measuring the sequential forging workpiece 204 with using the displacement sensor 209 and controlling a lower limit value in the forging with using the sequential forging upper die 203, the forming with higher precision can be achieved.

However, as different from the forming method of the second embodiment, extremely large forming pressure is required for the forging, and therefore, the forming proceeds only little by little. Therefore, the measurement with using the displacement sensor 209 is varied in the once forming. In such a case, as illustrated in FIG. 34, a controlling method for forming a region shown as "P=1" by the forming a plurality of times, and then, changing the lower limit value in the forging with using the sequential forging upper die 203 based on the data is appropriate.

<Forming Method of Sequential-Forging Bending>

Next, with reference to FIG. 35, a forming method for forming the sequential forging workpiece 204 with using the servo press according to the present embodiment is described. FIG. 35 is a flow chart illustrating the operation of the sequential-forging bending.

First, in a sequential forging workpiece installing process 212, the sequential forging workpiece 204 is installed. Subsequently, in a "pushing die transferred to initial position on X coordinate" process 213, a drive signal is sent from the die actuator drive command sending portion 193 to the die actuator 207, so that the pushing die 205 is moved to the initial position. In a substitute 1 to variable P process 214, 1 is substituted to the variable P. Subsequently, in a "substitute 1 to variable k" process 215, 1 is substituted to the variable k.

Subsequently, in a "slide descent to height Zs" process 216, the slide 4 is descended to the height Zs, so that the sequential forging workpiece 204 is formed with using the sequential forging upper die 203. Subsequently, in a "slide ascent to height Zsu (Zsu>Zs)" process 217, the slide 4 is ascended to the height Zsu so as to ascend the sequential forging upper die 203 to be released. Subsequently, in a "pushing die transferred to Xk" process 218, a drive signal is sent from a die actuator drive command sending portion 193 to a die actuator 207, so that the pushing die 205 is moved to the Xk position.

Subsequently, in a "judging k=n" process 219, it is judged whether a variable "k" reaches a predetermined number of times "n" or not. If the variable k has not reached yet (219-No), "k+1" is substituted to k in a "substitute k+1 to variable k" process 220, and the process is returned to a "slide descent to height Zs" process 216. If the variable k has reached "n" (219-Yes), the process proceeds to a "judging pushing-die reached to the end" process 221.

Subsequently, in the "judging pushing die reached to the end" process 221, it is judged whether the position of the pushing die 205 has reached the X end position or not. If the pushing die has not reached yet (221-No), the shape of the sequential forging workpiece 204 is measured in a measuring process 222, and a modified slide motion data is calculated in accordance with the shape in a "modified slide motion data calculation and Zs adjust" process 223, so that "Zs" is changed. Then, in a "substitute P=P+1" process 224, "P+1" is substituted to "P", and the process is returned to the "substitute 1 to variable k" process 215. In the "judging pushing die reached to the end" process 221, if the pushing die has reached the end (221-Yes), the process proceeds to a forming end process 225, and the forming is finished in the forming end process 225.

For example, an operation is repeated as measuring the result obtained by forming the above-described region "P=1" in FIG. 34 under the condition of the slide height of "Zs=Z1" and obtaining the value of Z2 by the calculation, subsequently, forming a region shown as "P=2" under a condition of the obtained slide height of "Zs=Z2". That is, the region shown as "P=1" in FIG. 34 is formed in accordance with the flow of 215 to 221, subsequently, the region shown as "P=2" is formed in accordance with the flow of 215 to 221, and then, "P" is incremented to repeat the forming thereafter until reaching the X end position.

<Sequential Forming Program Creating Portion of Control Device for Sequential Forming>

Next, a sequential forming program creating portion of the controlling device for the sequential forming according to the present embodiment is described with reference to FIG. 36. FIG. 36 is a view illustrating a sequential forming program creating display D. In the controlling device for the sequential forming which includes the sequential forming program creating portion for displaying the sequential forming program creating display D, its structure is the same as that illustrated in FIG. 28 in the above-described second embodiment.

The sequential forming program creating display D for the sequential forming program creating portion D226 is composed of: a sequential forming program table E227; a numerical keypad 81; an enter key 84; a delete key 77; a save key 85; and a cursor key 86.

In the sequential forming program table E227, values corresponding to items (slide motion No., Zs, Zsu, measuring target value, X initial, X last, X pitch, and measuring frequency) are illustrated in a matrix form.

In a first column (slide motion No.), a slide-motion identification number for invoking the slide motion created by the slide motion pattern creating portion 54 is inputted. In the slide motion, a lower limit value, an upper limit value, a measuring target value, and a measuring frequency of the slide are described as variables, and a slide motion program for feed forward control is created by reading these variables. Moreover, in each row, the start and the end are determined depending on the X-direction coordinate of the pushing die 205.

In the example of FIG. 36, the measuring target value is specified as the curvature radius, and the curvature radius is calculated from the value measured by the displacement sensor 209. If the calculated result is different from the target value, the value of Zs is changed. The feeding of 300 mm is carried out by a feeding pitch of 10 mm for the forming, and therefore, the sequential forming is carried out 30 times. Since the measuring frequency is carried out once per five-time forming, the curvature radius can be made closer to the target value by totally the five-time measurement.

In the controlling device for the sequential forming which has the functions of the present embodiment, the forming with good precision can be achieved by the feed forward control even in the forming method in which the measurement with sufficient precision cannot be achieved by each forming because of small displacement as described above.

Note that there may be provided a sequential forming program creating portion formed by integrating the slide motion data creating portion 30 with the functions described in the sequential forming program creating portion A195 of the second embodiment, the sequential forming program creating portion B197 thereof, the sequential forming program creating portion C199 thereof, and the sequential forming program creating portion D226 of the present embodiment.

<Effects of the Present Embodiment>

According to the present embodiment described above, the same effects as the above-described first and second embodiments can be obtained, and further, more particularly, the controlling device 194 for the sequential forming includes: the slide motion data changing portion 37; the measurement result receiving portion 25; and the die actuator drive command sending portion 193, changes the slide motion data for the next slide motion or a subsequent slide motion in accordance with the measurement result sent from the displacement sensor 209 which is the measurement equipment attached to the die 21 after forming the sequential forging workpiece 204 once or more, and drives the die actuator 207 so as to carry out the forming in accordance with the slide motion data, so that the optimal forming for handling the variability in the sheet thickness and material property of the workpiece and for handling each workpiece can be achieved, and therefore, the precision and quality of the formed product made of the sequential forging workpiece 204 can be improved.

In the foregoing, the invention made by the inventors of the present invention has been concretely described based on the embodiments. However, it is needless to say that the present invention is not limited to the foregoing embodiments and various modifications and alterations can be made within the scope of the present invention.

A controlling technique for a servo press according to the present invention is a technique effectively applied to a controlling device for a servo press of controlling an electric servo press to control a slide position, a controlling method for the same, and a servo press equipped with the controlling device.

What is claimed is:

1. A controlling device for a servo press for forming a workpiece with using a die, the servo press being controlled in accordance with a slide motion data for determining a forming operation of the workpiece, the controlling device comprising:

measurement equipment attached to the die for measuring a forming state of the workpiece;

a measurement result receiving portion for receiving a measurement result sent from the measurement equipment; and a slide motion data changing portion for changing the slide motion data for forming the same workpiece at scheduled measuring time in accordance with the measurement result received by the measurement result receiving portion; wherein the die includes: a movable die which is movable in the forming operation of the workpiece; and a fixed die which is fixed therein, and the die includes:

an upper die set plate to be the movable die;

an upper fixing die attached to the upper die set plate via a spring;

at least three or more linkage parts attached to the upper die set plate via an upper hinge base;

an upper holding die attached to the linkage parts via a lower hinge base;

a lower die set plate to be the fixed die;

a lower punch die attached to the lower die set plate and attached to a position opposed to the upper fixing die;

a guiding plate laterally-symmetrically attached so as to sandwich the lower punch die;

a lower fixing die attached to the guiding plate and attached at a position opposed to the upper holding die;

a linear guide for supporting the guiding plate without lateral move restraint; and a contour guide for defining movement of the guiding plate.

2. The controlling device for the servo press according to claim 1 wherein the servo press includes:

a bed attached to a lower part of a front surface of a main body of the servo press;

a bolster attached to an upper surface of the bed;

a slide attached at a position opposed to the bolster;

a frame to which the slide is attached without vertical move restraint;

a servo motor attached to the frame;

a speed reducer joined with the servo motor; and a conversion mechanism of rotational force to linear force, joined with the speed reducer and joined with the slide.

* * * * *